US005183731A

United States Patent [19]

Takahashi et al.

[11] Patent Number: 5,183,731

[45] Date of Patent: Feb. 2, 1993

[54] SILVER HALIDE COLOR PHOTOGRAPHIC LIGHT-SENSITIVE MATERIAL CONTAINING EPOXY COMPOUND

[75] Inventors: Osamu Takahashi; Nobuo Furutachi, both of Kanagawa, Japan

[73] Assignee: Fuji Photo Film Co., Ltd., Kanagawa, Japan

[21] Appl. No.: 646,442

[22] Filed: Jan. 25, 1991

Related U.S. Application Data

[63] Continuation of Ser. No. 234,113, Aug. 19, 1988, abandoned.

[30] Foreign Application Priority Data

Aug. 20, 1987 [JP] Japan ..... 62-207254

[51] Int. Cl.[5] ..... G03C 1/38; G03C 7/32

[52] U.S. Cl. ..... 430/551; 430/505; 430/552; 430/553; 430/555; 430/556; 430/557; 430/558

[58] Field of Search ..... 430/551, 556, 557, 555, 430/558, 552, 553, 505

[56] References Cited

U.S. PATENT DOCUMENTS

| | | | |
|---|---|---|---|
| 4,239,851 | 12/1980 | Aoki et al. | 430/377 |
| 4,540,657 | 9/1985 | Krishnamurthy | 430/546 |
| 4,748,100 | 5/1988 | Umemoto et al. | 430/505 |
| 4,770,985 | 9/1988 | Takeda et al. | 430/505 |

FOREIGN PATENT DOCUMENTS 213700 3/1987 European Pat. Off. .

2015184 9/1979 United Kingdom .

OTHER PUBLICATIONS

Patent Abstracts of Japan, vol. 11, No. 276, (P-613) (2733), Sep. 8, 1987.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide color photographic light-sensitive material having, on a support, at least an emulsion layer containing a yellow coupler represented by the general formula (I) and a sparingly water soluble epoxy compound represented by the general formula (II):

(I)

(II)

An excellent dye images with improved yellow image storability, particularly, heat and wet heat fastness can be obtained.

9 Claims, No Drawings

SILVER HALIDE COLOR PHOTOGRAPHIC LIGHT-SENSITIVE MATERIAL CONTAINING EPOXY COMPOUND

This is a continuation of application Ser. No. 07/234,113, filed Aug. 19, 1988, now abandoned.

FIELD OF THE INVENTION

The present invention concerns a silver halide color photographic light-sensitive material and, particularly, it relates to a silver halide color photographic lihgt-sensitive material with improved storability of yellow color image obtained by using less water soluble epoxy compounds.

BACKGROUND OF THE INVENTION

By applying color development after exposure to a silver halide photographic material, an aromatic primary amine developing agent oxidized with a silver halide and a color forming coupler are reacted to form color images.

In this method, the subtractive color process has often been used and, for reproducing blue, green and red colors, color images of yellow, magenta and cyan which respectively are complimentary to the above colors are formed.

Conventional yellow couplers include those using an imide group as a releasing group as disclosed, for example, in U.S. Pat. Nos. 4,022,620, 4,057,432, 4,269,936 and 4,404,274, those using a heterocyclic group as a releasing group as disclosed, for example, in U.S. Pat. Nos. 4,046,575, 4,326,024, which discclose an improvement in the color forming rate and fastness of color images.

Furthermore, for improving the fastness of color images formed from these yellow couplers, hindered amine type compounds as disclosed in U.S. Pat. No. 4,268,593 have been proposed.

However, as compound with the technical progress in magenta color images and cyan color images, less progress has been made in fastness of yellow color images. The fastness thereof remains at lower level than magenta and cyan color images, and an improvement is eagerly sought.

As has been described above, it is desirable in color photography that the fastness of yellow, magenta and cyan color images to light, heat and wet heat are uniformly strong, at identical levels for all three colors. The present inventors have generally sought compounds capable of improving the fastness of the color image of the yellow coupler.

There have been known epoxy compounds as disclosed in U.S. Pat. No. 4,239,851 that improve the fastness of cyan color images to heat and wet heat, epoxy compounds as disclosed in U.S. Pat. No. 4,540,657 which are effective to reduce yellow stains resulting from decomposition of magenta couplers. Although U.S. Pat. No. 4,540,657 describes the light and heat fastness of color images obtained from aryloxy-releasing yellow couplers, the effect thereof remains insufficient.

In addition, compounds such as cyclic ether compounds described in JP-A-62-75450 (the term JP-A as used herein means an "unexamined published Japanese patent application") are effective to reduce stains resulting from processing with a particular stabilizing solution. Surprisingly, it has now been found that epoxy compounds within the scope of the present invention can remarkably improve the fastness, particularly, light fastness, of the yellow color image used in the present invention.

SUMMARY OF THE INVENTION

Accordingly, it is a first object of the present invention to provide a silver halide color photographic light sensitive material capable of forming yellow color images which are fast to light and heat.

A second object of the present invention is to provide a silver halide color photographic light-sensitive material having an excellent balance for the fastness of color images of three colors, that is, yellow, magenta and cyan, particularly, the balance of the light fastness between yellow and magenta images.

It has now been found that these and other objects can been attained by a silver halide color photographic light-sensitive material composed of a support having thereon at least one light-sensitive emulsion layer containing at least one yellow coupler represented by the general formula (I) and a sparingly water soluble epoxy compound represented by the general formula (II):

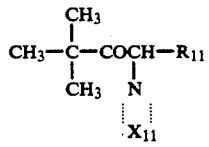

(I)

where $R_{11}$ represents an N-aryl carbamoyl group and $X_{11}$ represents a non-metallic atomic group required for forming a 5- or 6-membered ring; and the coupler may form a dimer or a higher polymer;

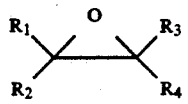

(II)

$R_1$, $R_2$, $R_3$ and $R_4$, which may be the same or different, each represents a hydrogen atom, an aliphatic group, an aryl group, an aliphatic oxycarbonyl group, an aromatic oxycarbonyl group or a carbamoyl group, provided at least one of $R_1$, $R_2$, $R_3$ and $R_4$ represents a group other than hydrogen atoms; total number of the carbon atoms contained in $R_1$, $R_2$, $R_3$ and $R_4$ is from 8 to 60; $R_1$ and $R_2$, $R_3$ and $R_4$, or $R_1$ and $R_3$ may be linked to form a 5- to 7-membered ring; at least one of $R_1$, $R_2$, $R_3$ and $R_4$ may have at least one epoxy group; and the epoxy compound may form a dimer or a higher polymer.

DETAILED DESCRIPTION OF THE INVENTION

The term "aliphatic group" as used in the present invention means a linear, branched or cyclic aliphatic hydrocarbon group and includes saturated and unsaturated groups such as alkyl, alkenyl and alkynyl groups.

The term "aromatic group" or "aryl group" used herein refers to a substituted or unsubstituted phenyl group or naphthyl group preferably with 6 to 42 carbon atoms.

The term "heterocyclic group" as used herein means a 5- to 7-membered heterocyclic group containing at least one of O, S and N atoms as a hetero atom.

The term "sulfonyl" as used herein includes aliphatic sulfonyl and aromatic sulfonyl.

The term "sulfonamido group" as used herein includes an aliphatic sulfonamido group and an aromatic sulfonamido group.

In addition, it has also been found that the objects of the present invention can be attained more effectively by using at least one of couplers represented by the general formula (M-I) and the general formula (M-II) as a magenta coupler for a light-sensitive emulsion layer in the silver halide color photosensitive material described above.

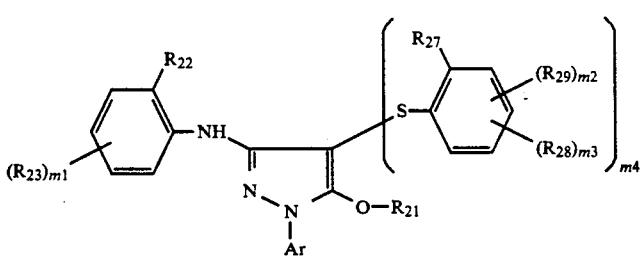

(M-I)

In formula (M-I), Ar represents an aryl group; $R_{21}$ represents a hydrogen atom, an acyl group, or a sulfonyl group, $R_{22}$ represents a halogen atom or an alkoxy group; $R_{23}$ represents an alkyl group, an aryl group, a halogen atom, an alkoxy group, an aryloxy group, an acylamino group, an imido group, a sulfonamido group, an alkoxycarbonyl group, a carbamoyl group, a sulfamoyl group, an alkylthio group or a sulfonyl group; $R_{27}$ represents an alkyl group, an alkoxy group, an aryloxy group or an acylamino group; $R_{29}$ represents a hydrogen atom, a halogen atom, a hydroxyl group, an alkyl group, an alkoxy group or an aryl group; $R_{28}$ represents an amino group, an acylamino group, a ureido group, an alkoxycarbonylamido group, an imido group, a sulfonamido group, a sulfamoylamino group, an alkoxycarbonyl group, a carbamoyl group, an acyl group, cyano group or an alkylthio group; provided that at least one of $R_{27}$ and $R_{29}$ represents an alkoxy group, ml is an integer of 1 to 4, m2 is an integer of 1 to 4, m3 is 0 or an integer of 1 to 3, m4 is 0 or 1, when m4 is 0, the coupling position is occupied by a hydrogen atom; and the coupler may form a dimer or a higher polymer.

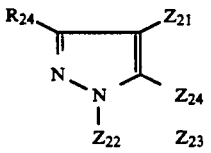

(M-II)

$R_{24}$ represents a hydrogen atom or a substituent; $Z_{21}$ represents a hydrogen atom or a coupling-off group capable of being released by a reaction with an oxidized product of an aromatic primary amine color developing agent; $Z_{22}$, $Z_{23}$ and $Z_{24}$, which may be the same or different, each represents $$-\overset{R_{24}}{\overset{|}{C}}=,\ -N=\ \text{or}\ -NH-,$$

provided that one of the $Z_{24}$–$Z_{23}$ bond and the $Z_{23}$–$Z_{22}$ bond is a double bond and the other is a single bond, when the $Z_{23}$– $Z_{22}$ bond is a carbon-carbon double bond, it constitutes a part of an aromatic ring; and the coupler may form a dimer or a higher polymer.

Referring more specifically to the yellow coupler represented by the general formula (I), specific examples of the N-aryl carbamoyl group represented by $R_{11}$ are an N-phenylcarbamoyl group or a substituted N-phenylcarbamoyl group having 7 to 42 carbon atoms.

The substituent can include an aliphatic group (for example, methyl, allyl and cyclopentyl), a heterocyclic group (for example, 2-pyridyl, 2-imidazolyl, 2-furyl and 6-quinolyl), an aliphatic oxy group (for example, methoxy, 2-methoxyethoxy and 2-propenyloxy), an aromatic oxy group (for example, 2,4-di-tert-amylphenoxy, 4-cyanophenoxy and chlorophenoxy), an acyl group (for example, acetyl and benzoyl), an ester group (for example, butoxy carbonyl, hexadecyloxy carbonyl, phenoxy carbonyl, dodecyloxy carbonyl, methoxycarbonyl, acetoxy, benzoyloxy, tetradecyloxy sulfonyl or hexadecane sulfonyloxy), an amido group (for example, acetylamino, dodecanesulfonamido, 2-butoxy-5-tetradecane sulfonamido, phenylsulfonamido, α-(2,4-di-tert-pentylphenoxy)butanamido, or γ-(2,4-di-tert-pentylphenoxy)butanamido, a carbamoyl group (for example, N-tetradecylcarbamoyl, N,N-dihexylcarbamoyl), a sulfamoyl group (for example, N-butanesulfamoyl, N-methyl-N-tetradecanesulfamoyl), an imido group (for example, succineimido, N-hydantoinyl, 3-hexadecenylsuccinimido), a ureido group (for example, phenylureido, N,N-dimethylureido, N-(3-(2,4-di-tert-pentylphenoxy)propyl)ureido), a sulfonyl group (for example, methanesulfonyl, phenylsulfonyl, dodecanesulfonyl, 2-butoxy-5-tert-octylbenzene sulfonyl), an aliphatic or aromatic thio group (for example, phenylthio, ethylthio, hexadecylthio, 4-(2,4-di-tert-phenoxyacetamido)benzylthio), a hydroxyl group, a sulfonic acid group, or a halogen atom (for example, fluorine, chlorine or bromine). Where there are two or more substituents, they may be identical or different.

$X_{11}$ represents a non-metallic atomic group required for forming a 5- or 6-membered ring.

Preferred specific examples of the 5- or 6-membered ring are represented by the following general formulae (III) to (V):

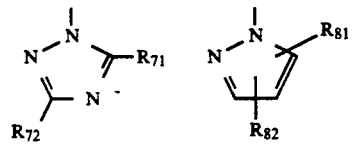

(III) (IV)

where $R_{71}$, $R_{72}$, $R_{81}$ and $R_{82}$, which may be the same or different, each represents a hydrogen atom, a halogen atom, a carboxylic ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group or a substituted or unsubstituted heterocyclic group.

(V)

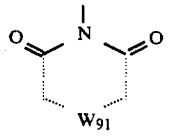

where $W_{91}$ represents a non-metallic atomic required for forming a 5-membered or 6-membered ring together with

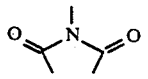

in the formula.

Further preferred specific examples of the group represented by general formula (V) are represented by the following formulae (VI) to (VIII).

(VI)

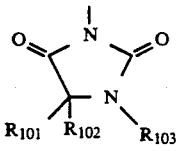

(VII)

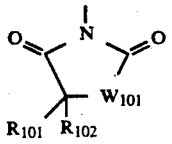

(VIII)

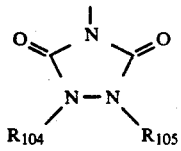

Where $R_{101}$ and $R_{102}$, which may be the same or different, each represents a hydrogen atom, an alkyl group, an aryl group, an alkoxy group, an aryloxy group or a hydroxyl group; $R_{103}$, $R_{104}$ and $R_{105}$, which may be the same or different, each represents a hydrogen atom, an alkyl group, an aryl group, an aralkyl group or an acyl group; and $W_{101}$ represents an oxygen or sulfur atom.

More preferred yellow couplers represented by general formula (I) are represented by the following general formula (I-A).

(I-A)

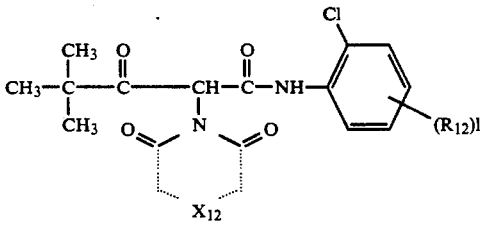

wherein $X_{12}$ represents a non-metallic atomic group necessary for forming a 5-membered ring; $R_{12}$ represents a substituent the same as those defined for the substituted N-phenylcarbamoyl group described above for $R_{11}$, among which are preferred an aliphatic group, an aliphatic oxy group, an aromatic oxy group, an ester group, an amido group, a carbamoyl group, a sulfamoyl group, an imido group or a halogen atom and l represents an integer of from 1 to 4, preferably 1.

Specific examples of the 5-membered ring formed by $X_{12}$ are represented by the foregoing general formulae (VI), (VII) and (VIII), and those represented by the general formula (VI) and (VII) are particularly preferred. Particularly preferred examples represented by general formula (VI) are those in which at least one of $R_{101}$ and $R_{102}$ represents a group other thana hydrogen atom.

The couplers represented by the general formula (I) are disclosed, for example, in U.S. Pat. Nos. 4,622,287 and 4,623,616. Specific examples of the couplers are shown below, but the present invention is not to be construed as being limited thereto.

(I-1)

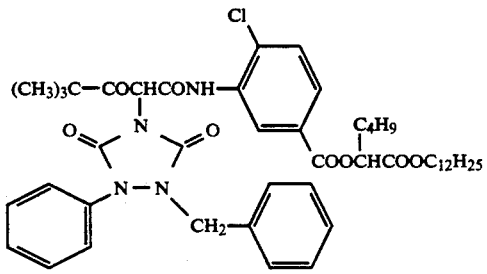

-continued
(I-2)
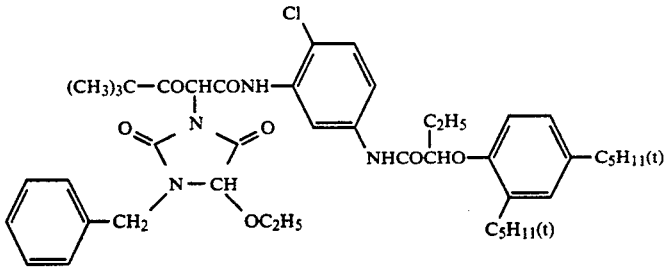
(I-3)
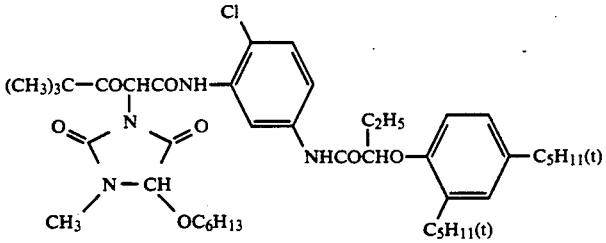
(I-4)
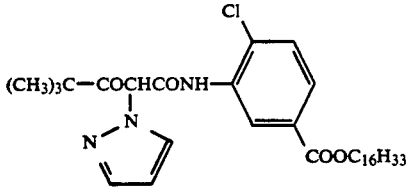
(I-5)
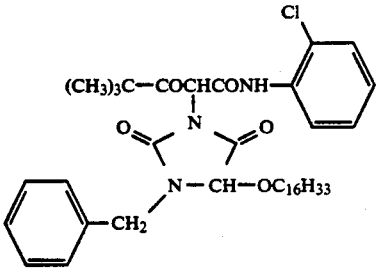
(I-6)
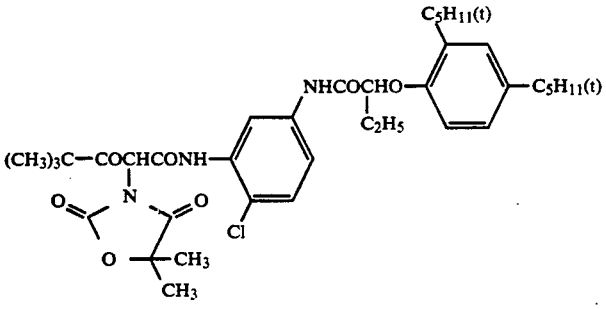
(I-7)
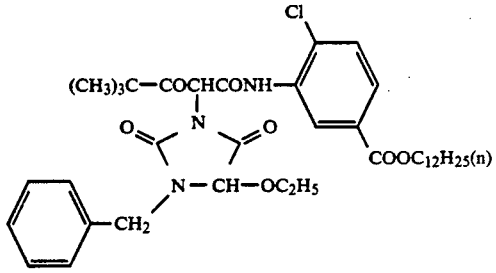

-continued
(I-8)
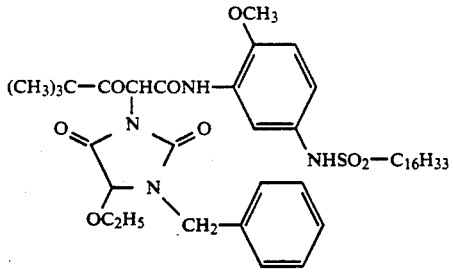
(I-9)
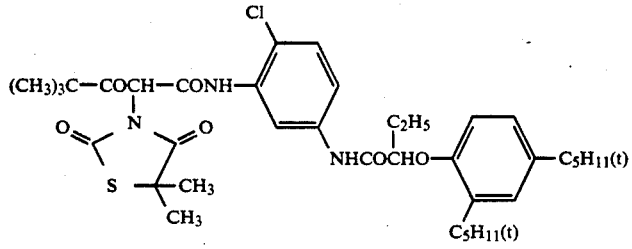
(I-10)
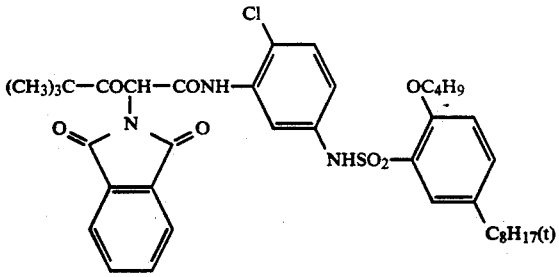
(I-11)
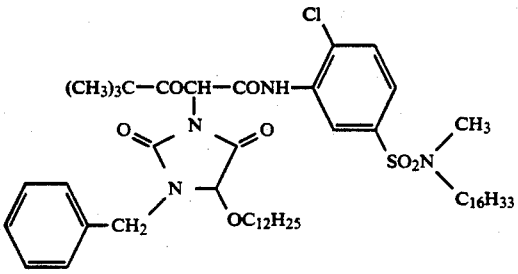
(I-12)
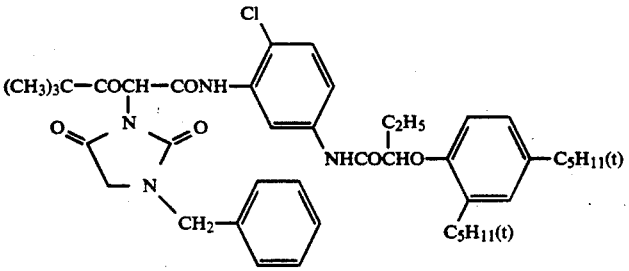
(I-13)
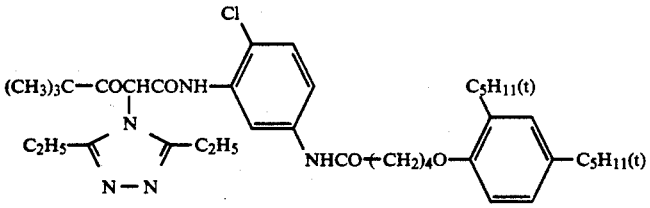

-continued (I-14)

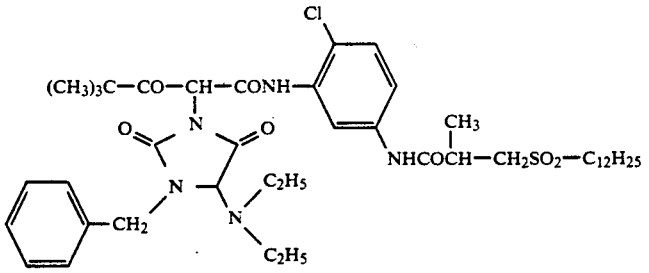

(I-15)

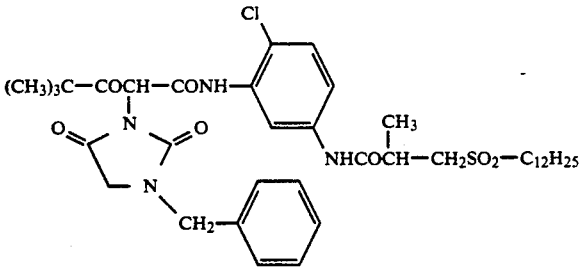

(I-16)

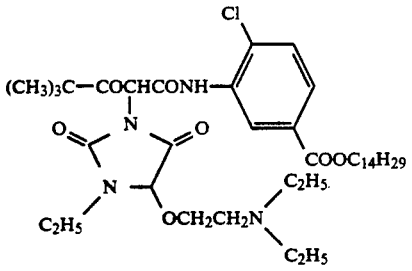

(I-17)

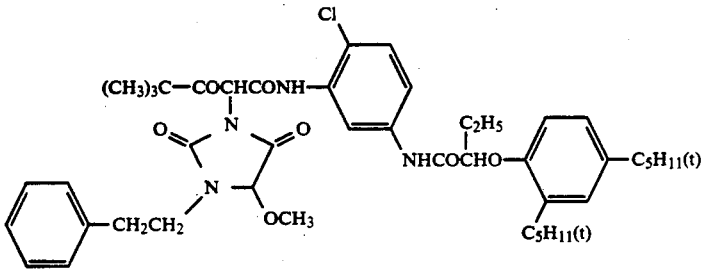

(I-18)

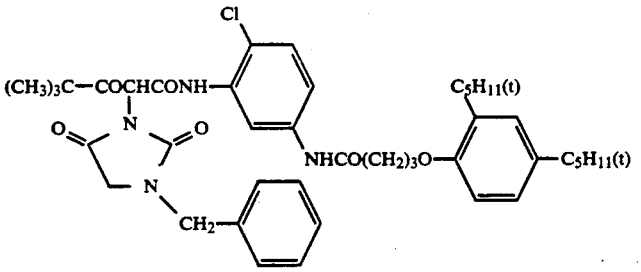

The epoxy compounds represented by general formula (II) preferably have solubility in water (at 18° C.) of not more than 1% by weight.

In the general formula (II), $R_1$, $R_2$, $R_3$ and $R_4$ represent a hydrogen atom, an aliphatic group, an aryl group, an aliphatic oxy carbonyl group (for example, dodecyloxy carbonyl, allyloxy carbonyl), an aromatic oxy carbonyl group (for example, phenoxy carbonyl group) or a carbamoyl group (for example, tetradecylcarbamoylphenylmethylcarbamoyl), provided that not all of $R_1$, $R_2$, $R_3$ and $R_4$ represent hydrogen atoms and the total number of carbon atoms of these groups is from 8 to 60, preferably from 15 to 60.

Typical examples of the aliphatic group are methyl, ethyl, butyl, dodecyl, octadecyl, eicosenyl, isopropyl, tert-butyl, tert-octyl, tert-dodecyl, cyclohexyl, cyclopentyl, allyl, vinyl, 2-hexadecenyl, and propargyl.

These aliphatic groups and aryl groups may further be substituted with a group selected from an alkyl group, an aryl group, a heterocyclic group, an alkoxy group (for example, methoxy, 2-methoxyethoxy), an aryloxy group (for example, 2,4-di-tert-amylphenoxy, 2-chlorophenoxy, 4-cyanophenoxy), an alkenyloxy group (for example, 2-propenyloxy), an acyl group (for example, acetyl or benzoyl), an ester group (including an alkoxycarbonyl group, an aryloxycarbonyl group and an acyloxy group, and a phosphoric acid ester group, for example, butoxycarbonyl, phenoxycarbonyl, acetoxy, benzoyloxy, butoxysulfonyl or toluene sulfonyloxy), an amido group (for example, acetylamino), a carbamoyl gorup (for example, ethylcarbamoyl or dimethylcarbamoyl), a sulfamoyl (for example, butyl sulfamoyl), a sulfamido group (for example, methanesulfonamido), a sulfamoyl amino group (for example, dipropylsulfamoyl amino), an imido group (for example, succinimido, hydantoinyl), a ureido group (for example, phenylureido, dimethylureido), a sulfonyl group (for example, methanesulfonyl or phenylsulfonyl), an aliphatic or aromatic thio group (for example, ethylthio or phenylthio), a hydroxyl group, a cyano group, a carboxyl group, a nitro group, a sulfonic acid group, and a halogen atom.

The epoxy compounds according to the present invention represented by the general formula (II) and synthetic methods thereof are disclosed, for example, in U.S. Pat. Nos. 4,239,851 and 4,540,657 and JP-A-62-75450. Specific examples of the epoxy compound are shown below, but the present invention is not be construed as being limited thereto.

(II-1)

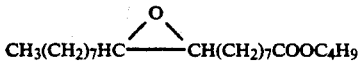

(II-2)

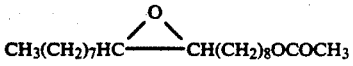

(II-3)

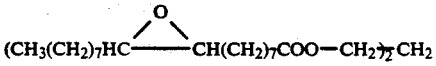

(II-4)

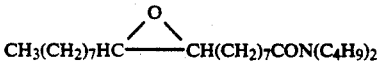

(II-5)

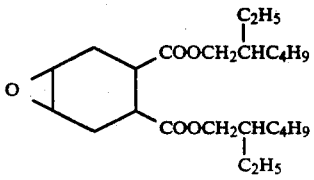

(II-6)

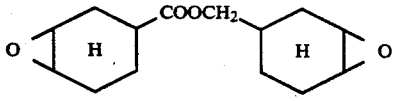

(II-7)

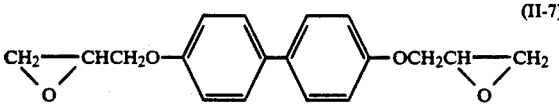

(II-8)

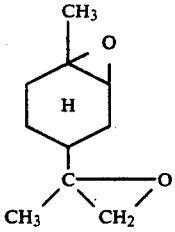

-continued (II-9)

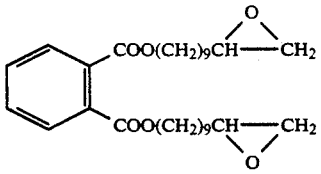

(II-10)

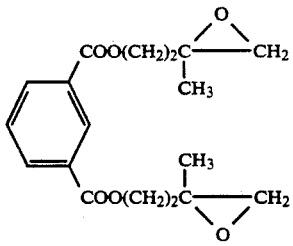

(II-11)

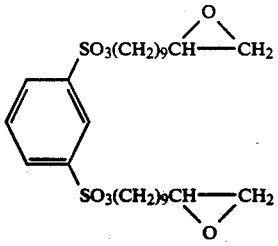

(II-12)

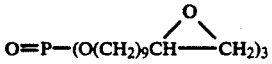

(II-13)

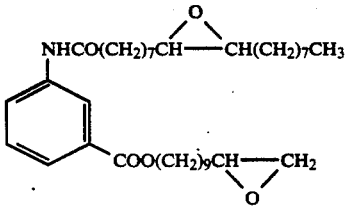

(II-14)

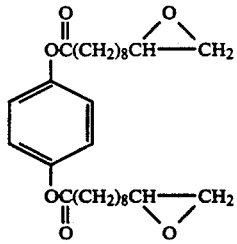

(II-15)

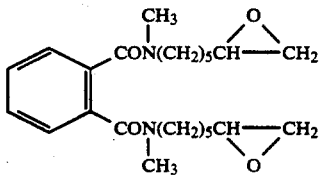

(II-16)

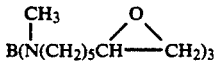

-continued

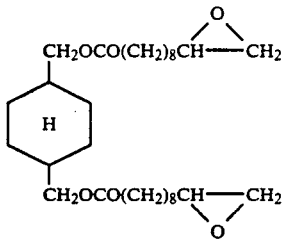

(II-17)

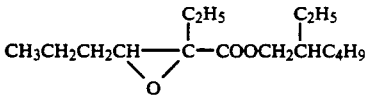

(II-18)

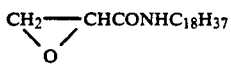

(II-19)

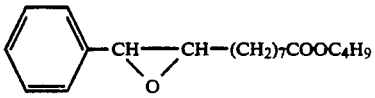

(II-20)

The epoxy compound used in the present invention can be added in co-emulsification with the yellow coupler of the formula (I) to a silver halide photographic emulsion. For the co-emulsification, a high boiling solvent described later may be used together.

The amount of the yellow coupler is generally from $1\times10^{-2}$ to 1 mol, preferably from $1\times10^{-1}$ to $5\times10^{-1}$ mol per mol silver halide in the silver halide emulsion layer.

The amount of the epoxy compound is generally within a range from 0.5 to 300% by weight, preferably, within the range from 20 to 200% by weight by weight, based on the yellow coupler of the formula (I).

Specific examples of the substituents of the general formula (M-I) are now explained in greater detail.

Ar represents an aryl group with 6 to 36 carbon atoms (for example, phenyl, 2,4,6-trichlorophenyl, 2,5-dichlorophenyl, 2,6-dichloro-4-methoxyphenyl, 2,4-dimethyl-6-methoxyphenyl, 2,6-dichloro-4-ethoxycarbonylphenyl, 2,6-dichloro-4-cyanophenyl); $R_{21}$ represents a hydrogen atom, an acyl group with 2 to 10 carbon atoms (for example, acetyl, benzoyl, propanoyl, butanoyl and monochloroacetyl), an aliphatic or aromatic sulfonyl group with 1 to 16 carbon atoms (for example, methanesulfonyl, butanesulfonyl, benzenesulfonyl, toluenesulfonyl and 3-hydroxypropanesulfonyl); $R_{22}$ represents a halogen atom (for example, chlorine, bromine and fluorine) or an alkoxy group with 1 to 22 carbon atoms (for example, methoxy, butoxy, benzyloxy and 2-methoxyethoxy); $R_{23}$ represents an alkyl group with 1 to 24 carbon atoms (for example, methyl, butyl, t-butyl, t-octyl, dodecyl, 2,4-di-tert-pentylphenoxymethyl and hexadecyl), an aryl group preferably having from 6 to 36 carbon atoms (for example, phenyl and 2,4-dichlorophenyl), a halogen atom (for example, chlorine, fluorine and bromine), an alkoxy group with 1 to 22 carbon atoms (for example, methoxy, dodecyloxy, benzyloxy and hexadecyloxy), an aryloxy group with 6 to 36 carbon atoms (for example, phenoxy and 4-dodecylphenoxy), an acylamino group with 2 to 36 carbon atoms (for example, acetylamino, tetradecanamido, α-(2,4-di-tert-pentylphenoxy)-butylamido, α-(4-hydroxy-3-tert-butylphenoxy)tetradecanamido and o-(4-(4-hydroxyphenylsulfonyl)-phenoxy)dodecanamido), an imido group with 2 to 36 carbon atoms (for example, N-succinimido, N-maleinimido, 1-N-benzyl-5,5-dimethyl-hydantoin-3-yl and 3-hexadecenyl-1-succinimido), a sulfonamido group with 1 to 36 carbon atoms (for example, methane sulfonamido, benzene sulfonamido, tetradecane sulfonamido, 4-dodecyloxybenzene sulfonamido and 2-octyloxy-5-tert-octylbenzene sulfonamido), an alkoxycarbonyl group with 1 to 22 carbon atoms (for example, ethoxycarbonyl, dodecyloxycarbonyl and hexadecyloxycarbonyl), a carbamoyl group with 1 to 36 carbon atoms (for example, N-phenylcarbamoyl, N-ethylcarbamoyl, N-dodecylcarbamoyl, N-(2-dodecyloxyethyl)carbamoyl, N-(3-(2,4-di-tert-pentylphenoxy)propyl)carbamoyl), a sulfamoyl group with 1 to 36 carbon atoms (for example, N,N-diethylsulfamoyl, N-ethyl-N-(2-dodecyloxyethyl)sulfamoyl, N-(3-(2,4-di-tert-pentylphenoxy)propyl)sulfamoyl), an alkylthio group with 1 to 22 carbon atoms (for example, ethylthio, dodecylthio, octadecylthio and 3-(2,4-di-tert-phenoxy)propylthio) or a sulfonyl group with 1 to 36 carbon atoms (for example, methanesulfonyl, tetradecanesulfonyl, i-octadecanesulfonyl, benzenesulfonyl). $R_{23}$ is preferably present at the meta position with respect to —NH— group.

$R_{27}$ represents alkyl group with 1 to 22 carbon atoms (for example, methyl, ethyl, n-hexyl, n-dodecyl, t-butyl, 1,1,3,3-tetramethylbutyl, 2-(2,4-di-tert-amylphenoxy)ethyl), an alkoxy group with 1 to 22 carbon atoms (for example, methoxy, ethoxy, n-butoxy, n-octyloxy, 2-ethylhexyloxy, n-dodecyloxy, n-hexadecyloxy, 2-ethoxyethoxy, 2-dodecyloxyethoxy, 2-methanesulfonylethoxy, 2-methanesulfonamido 3-(N-2-hydroxyethylsulfamoyl)propoxy, 2-(N-2-methoxyethylcarbonyl)ethoxy), an aryloxy group with 6 to 32 carbon atoms (for example, phenoxy, 4-chlorophenoxy, 2,4-dichlorophenoxy, 4-methoxyphenoxy, 4-dodecyloxyphenoxy and 3,4-methylenedioxyphenoxy) or an acylamino group including an aliphatic, aromatic and heterocyclic acylamino groups.

The aliphatic acylamino group includes a cycloalkyl carbonylamino group. The preferred aliphatic acylamino group is a branched alkyl carbonylamino group and the most preferred group is $—NHCOC_4H_9(t)$.

Examples of the aromatic acylamino includes a benzoylamino group and a benzoylamino group of which the benzene ring is substituted with, for example, a halogen atom (e.g., bromine atom, chlorine atom) or an alkoxy group.

An example of the heterocyclic acylamino group is

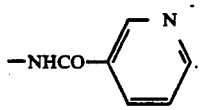

$R_{29}$ represents a hydrogen atom, a halogen atom (for example, fluorine, chlorine and bromine), a hydroxy group, an alkyl or alkoxy group with 1 to 22 carbon atoms as defined in $R_{27}$, an aryl group with 6 to 32 carbon atoms (for example, phenyl, 2,4-dichlorophenyl, 4-methoxyphenyl, 4-dodecyloxyphenyl, 2,4-di-tert-amylphenoxy, 4-tert-octylphenyl and 4-(2-ethylhexanamido)phenyl).

$R_{28}$ represents an amino group (a substituted or unsubstituted amino group such as an N-alkylamino group, an N,N-dialkylamino group, an N-anilino group, an N-alkyl-N-arylamino group and a heterocyclic amino group. The carbon number of the alkyl group in these groups are preferably from 1 to 22 and the aryl group in these groups are preferably from 6 to 32. Examples of these groups include N-butylamino, N,N-diethylamino, N-(2-(2,4-di-tert-amylphenoxy)ethyl)amino, N,N-dibutylamino, N-piperidino, N,N-bis-(2-dodecyloxyethyl)amino, N-cyclohexylamino, N,N-dihexylamino, N-phenylamino, 2,4-di-tert-amylphenylamino, N-(2-chloro-5-tetradecanamidophenyl-)amino, N-methyl-N-phenylamino, N-(2-pyridyl-)amino), an acylamino group (for example, acetamido, benzamido, tetradecanamido, (2,4-di-tert-amylphenoxy)acetamido, 2-chlorobenzamido, 3-pentadecylbenzamido, 2-(2-methanesulfonamidephenoxy)-dodecanamido, 2-(2-chlorophenoxy)tetradecanamido), a ureido group (for example, methylureido, phenylureido and 4-cyanophenylureido), an alkoxycarbonylamino group (for example, methoxy carbonylamino, dodecyloxycarbonylamino, 2-ethyloxycarbonylamino), an imido group (for example, N-succinimido, N-phthalimido, N-hydantoinyl, 5,5-dimethyl-2,4-dioxooxazol-3-yl, N-(3-octadecenyl)succinimido), a sulfonamido group (for example, methane sulfonamido, octane sulfonamido, benzene sulfonamido, 4-chlorobenzene sulfonamido, 4-dodecylbenzene sulfonamido, N-methyl-N-benzene sulfonamido, 4-dodecyloxybenzene sulfonamido and hexadecane sulfonamido), a sulfamoylamino group (for example, N-octyl sulfamoylamino, N,N-dipropyl sulfamoylamino, N-ethyl-N-phenyl sulfamoylamino, N-(4-butyloxy)sulfamoylamino), an alkoxycarbonyl group (for example, methoxycarbonyl, butoxycarbonyl, dodecyloxycarbonyl and benzyloxycarbonyl), a carbamoyl group (for example, N-octylcarbamoyl, N,N-dibutylcarbamoyl, N-phenylcarbamoyl and N-(3-(2,4-di-tert-amylphenoxy)propyl)carbamoyl), an acyl group (for example, acetyl, benzoyl, hexanoyl, 2-ethylhexanoyl and 2-chlorobenzoyl), a cyano group, an alkylthio group (for example, dodecylthio, 2-ethylhexylthio, benzylthio, 2-oxocyclohexylthio, 2-(ethyltetradecanoate)thio, 2-(dodecylhexanoate)thio, 3-phenoxypropylthio and 2-dodecane sulfonylethylthio).

$R_{28}$ and $R_{29}$ are preferably present at the metha and/or para position with respect to the —S— group.

Among the compound represented by the general formula (M-I), particularly preferred compounds are compounds in which $R_{21}$ represents a hydrogen atom, $R_{22}$ represents a halogen atom, $R_{27}$ represents an alkoxy group with 1 to 22 carbon atoms, ml and m2 each is 1, and m3 is 0.

Specific examples of the substituent for $R_{24}$ in the general formula (M-II) include, for example, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio a group, heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group and an aryloxycarbonyl group. The carbon numbers of groups represented by $R_{24}$ are the same as those of $R_{29}$.

More specifically, these substituentsinclude a halogen atom (for example, chlorine and bromine), an alkyl group (for example, methyl, propyl, isopropyl, t-butyl, trifluoromethyl, tridecyl, 3-(2,4-di-t-amylphenoxy)propyl, allyl, 2-dodecyloxyethyl, 3-phenoxypropyl, 2-hexylsulfonylethyl, 3-(2-butoxy-5-t-hexylphenylsulfonyl)-propyl, cyclopentyl and benzyl), an aryl group (for example, phenyl, 4-t-butylphenyl, 2,4-di-t-amylphenyl and 4-tetradecanamidophenyl), a heterocyclic group (for example, 2-furyl, 2-thienyl, 2-pyrimidinyl and 2-benzothiazolyl), a cyano group, an alkoxy group (for example, methoxy, ethoxy, 2-methoxyethoxy, 2-dodecyloxyethoxy, 2-phenoxyethoxy and 2-methanesulfonylethoxy), an aryloxy group (for example, phenoxy, 2-methylphenoxy, 2-methoxyphenoxy, 4-t-butylphenoxy), a heterocyclic oxy group (for example, 2-benzimidazolyloxy), an aliphatic and aromatic acyloxy group (for example, acetoxy and hexadecanoyloxy), a carbamoyloxy group (for example, N-phenylcarbamoyloxy and N-ethylcarbamoyloxy), a silyloxy group (for example, trimethylsilyloxy), a sulfonyloxy group (for example, dodecylsulfonyloxy), an acylamino group (for example, acetamido, benzamido, tetradecanamido, α-(2,4-di-t-amylphenoxy)butylamido, γ-(3-t-butyl-4-hydroxyphenoxy)butylamido and α-(4-(4-hydroxyphenylsulfonyl)phenoxy)decanamido), an anilino group (for example, phenylamino, 2-chloroanilino, 2-chloro-5-tetradecanamidoanilino, 2-chloro-5-dodecyloxycarbonylanilino, N-acetylanilino, 2-chloro-5-(α-(3-t-butyl-4-hydroxyphenoxy)-dodecanamido)- }anilino), a ureido group (for example, phenylureido, methylureido, N,N-dibutylureido), an imido group (for example, N-succineimido, 3-benzylhydantoinyl, 4-(2-ethylhexanoylamino)phthalimido), a sulfamoylamino group (for example, N,N-dipropylsulfamoylamino and N-methyl-N-decylsulfamoylamino), an alkylthio group (for example, methylthio, octylthio, tetradecylthio, 2-phenoxyethylthio, 3-phenoxypropylthio and 3-(4-t-butylphenoxy)propylthio), an arylthio group (for example, phenylthio, 2-butoxy-5-t-octylphenylthio, 3-pentadecylphenylthio, 2-carboxyphenylthio and 4-tetradecanamidophenylthio), a heterocyclic thio group (for example, 2-benzothiazolylthio), an alkoxycarbonylamino group (for example, methoxycarbonylamino and tetradecyloxycarbonylamino), an aryloxycarbonylamino group (for example, phenoxycarbonylamino and 2,4-di-tert-butylphenoxycarbonylamino), a sulfonamido group (for example, methanesulfonamido, hexadecanesulfonamido, benzenesulfonamido, p-toluenesulfonamido, octadecanesulfonamido and 2-methyloxy-5-t-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl and N-(3-(2,4-di-tert-amylphenoxy)propyl)carbamoyl), an acyl group (for example, acetyl-(2,4-di-tert-amylphenoxy)acetyl and benzoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl and N,N-diethylsulfamoyl), a sulfonyl group (for example, methanesulfonyl, octanesulfonyl, benzenesulfonyl, toluenesulfonyl and 2-butoxy-5-tert-octylphenylsulfonyl), a sulfinyl group (for example, octanesulfinyl, dodecylsulfinyl and phenylsulfinyl), an alkoxycarbonyl group (for example, methoxycarbonyl, butyloxycarbonyl, dodecyloxycarbonyl and octadecyloxycarbonyl), aryloxycarbonyl group (for example, phenyloxycarbonyl and 3-pentadecyloxycarbonyl).

In the general formula (M-II), $Z_{21}$ represents a hydrogen atom or a releasing group in the reaction with an oxidized product of an aromatic primary amine color developing agent. Referring more specifically to the releasing group $Z_{21}$, it includes a halogen atom (for example, fluorine, chlorine and bromine), an alkoxy group (for example, dodecyloxy, dodecyloxycarbonylmethoxy, methoxycarbamoylmethoxy, and carboxypropyloxy), an aryloxy group (for example, 4-methylphenoxy, 4-tert-butylphenoxy, 4-methoxyphenoxy, 4-methanesulfonylphenoxy and 4-(4-benzyloxyphenylsulfonyl)phenoxy), an acyloxy group (for example, acetoxy, tetradecanoyloxy and benzoyloxy), a sulfonyloxy group (for example, methanesulfonyloxy and toluenesulfonyloxy), an amido group (for example, dichloroacetylamino, methanesulfonylamino, triphenylphosphonamido), an alkoxycarbonyloxy group (for example, ethoxycarbonyloxy and benzyloxycarbonyloxy), aan ryloxycarbonyloxy group (for example, phenoxycarbonyloxy), an aliphatic or aromatic thio group (for example, phenylthio, dodecylthio, benzylthio, 2-butoxy-5-tert-octylphenylthio, 2,5-di-octyloxyphenylthio, 2-(2-ethoxyethoxy)-5-tert-octylphenylthio and tetrazolylthio), an imido group (for example, succinimido, hydantoinyl, 2,4-dioxooxazolidin-3-yl and 3-benzyl-4-ethoxyhydantoin-1-yl), an N-containing heterocyclic ring (for example, 1-pyrazolyl, 1-benzotriazolyl and 5-chloro-1,2,4-triazol-1-yl), and an aromatic azo group (for example, phenylazo). These releasing group may include photographically useful groups.

The coupler may form a dimer or higher polymer at a group of $R_{24}$, $Z_{21}$, $Z_{22}$ or $Z_{23}$ in the general formula (M-II) .

Among the compounds represented by the general formula (M-II), particularly preferred compounds are represented by the general formula (M-III) or (M-IV).

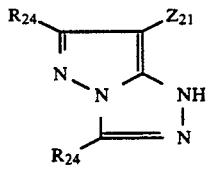

(M-III)

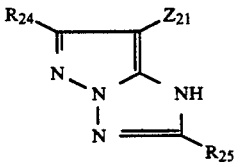

(M-IV)

where $R_{24}$ and $Z_{21}$ have the Same meanings as in the general formula (M-II), and $R_{25}$ has the same meaning as $R_{24}$. The $R_{24}$ and $R_{25}$ groups may be identical or different.

The compounds represented by the general formula (M-III) or (M-IV) may form a dimer or a higher polymer.

Among the compounds represented by general formulae (M-III) and (M-IV), those represented by the general formula (M-IV) are particularly preferred.

Examples of the magenta coupler represented by the general formula (M-I) or general formula (M-II) are described below, but the present invention is not restricted thereto.

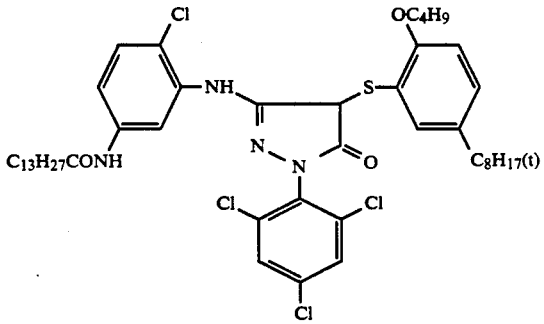

(M-1)

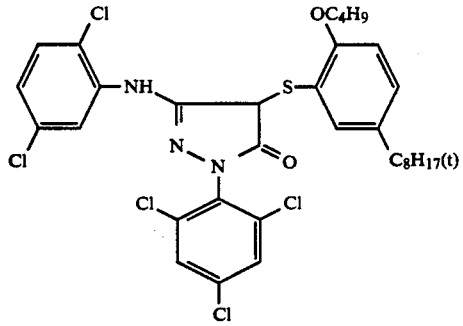

(M-2)

-continued
(M-3)
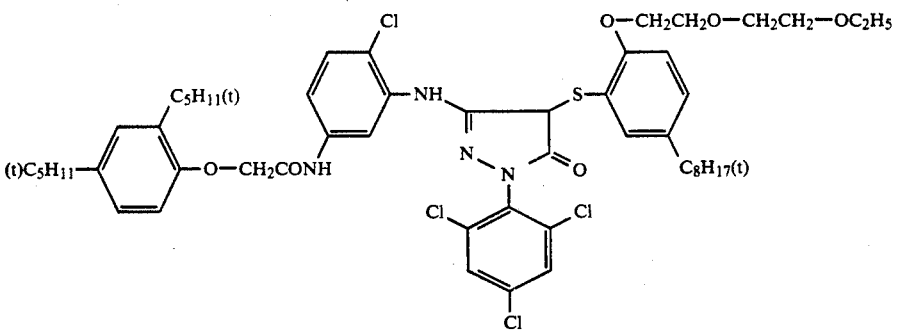
(M-4)
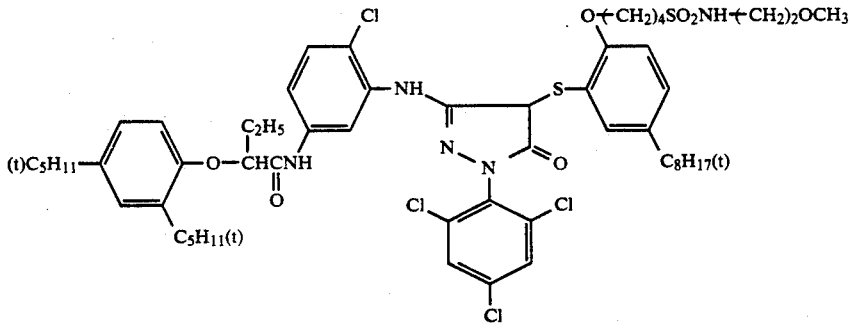
(M-5)
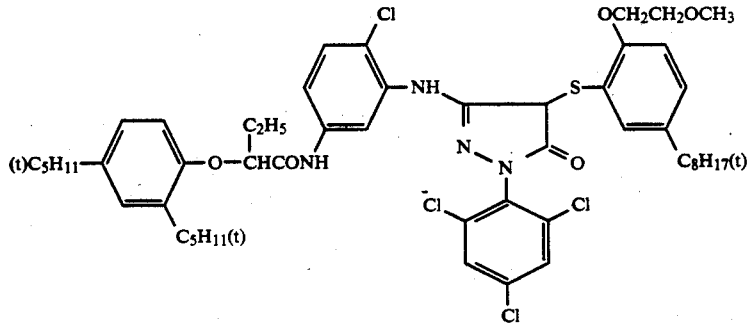
(M-6)
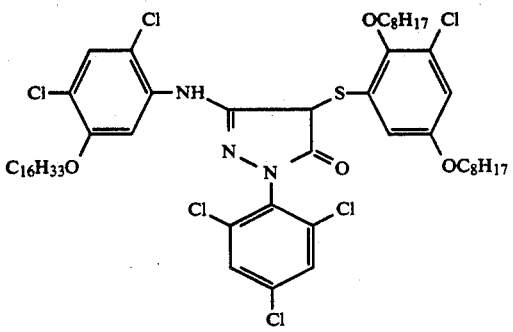
(M-7)
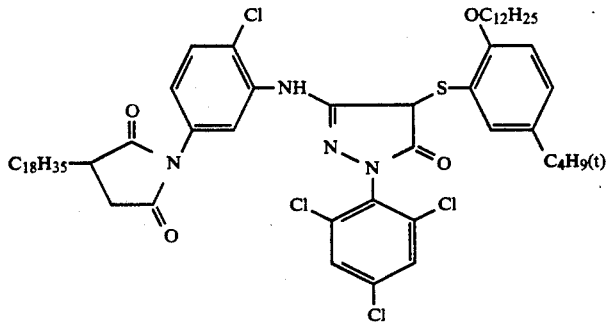

-continued
(M-8)
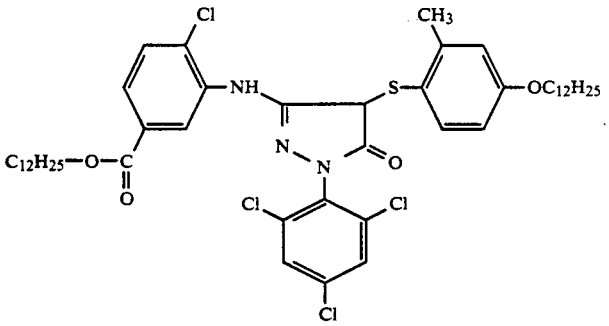
(M-9)
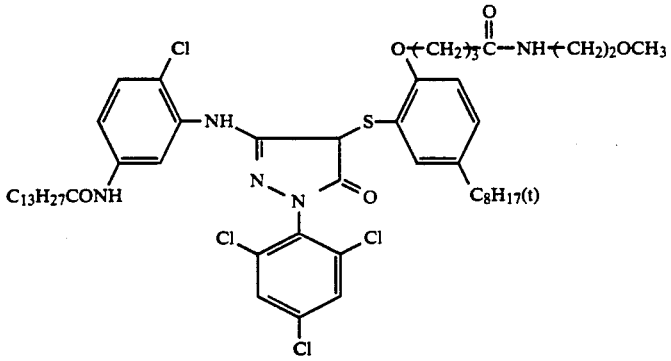
(M-10)
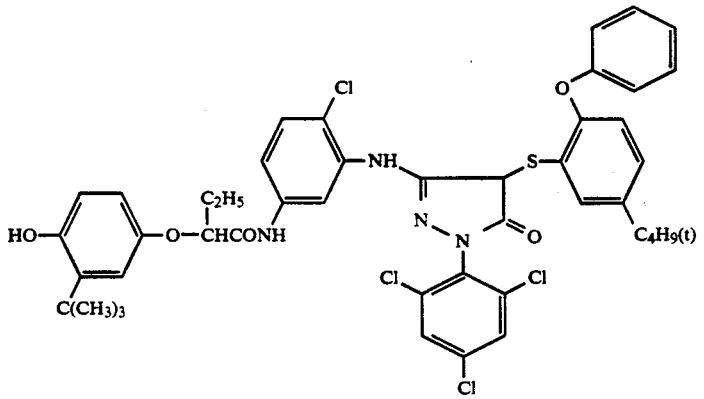
(M-11)
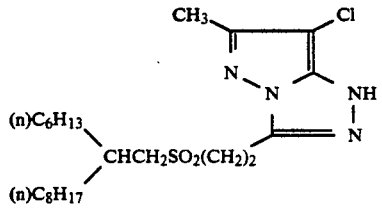
(M-12)
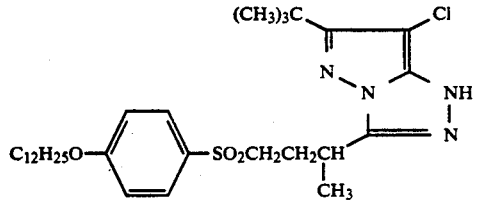

-continued
(M-13)
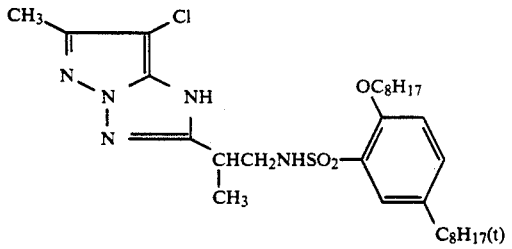
(M-14)
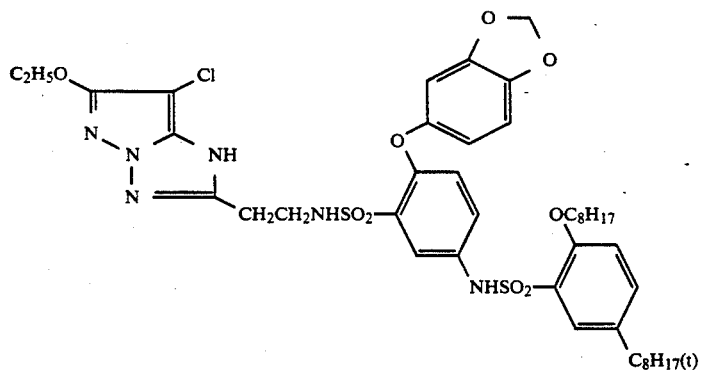
(M-15)
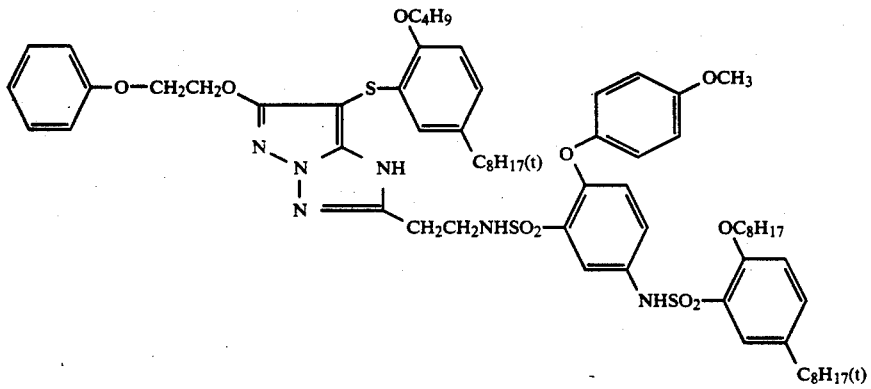
(M-16)
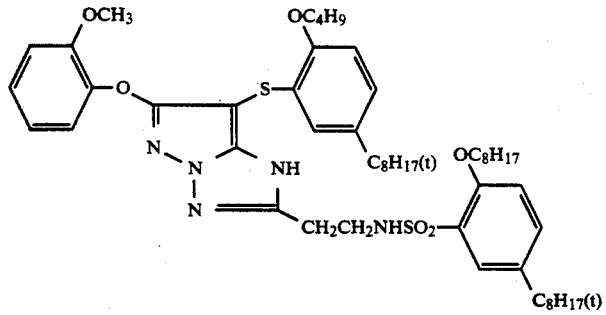
(M-17)
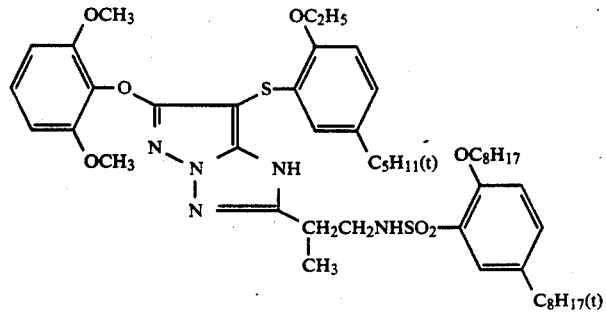

-continued
(M-18)
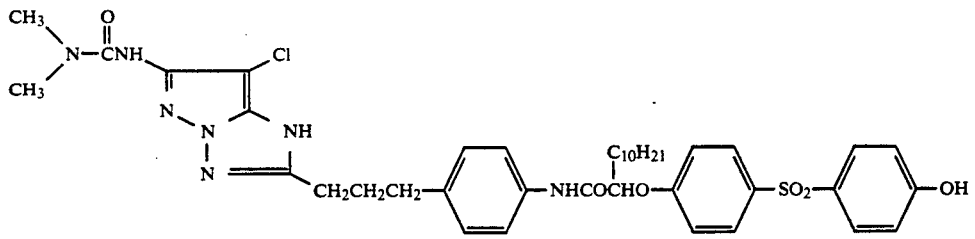
(M-19)
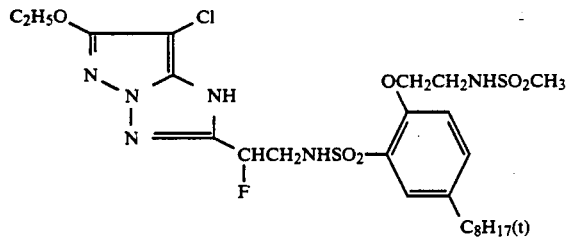
(M-20)
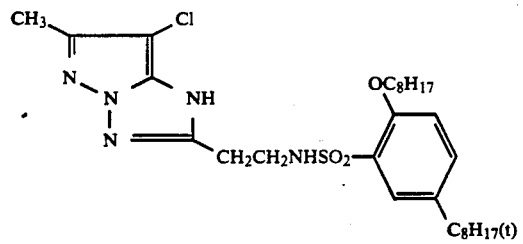
(M-21)
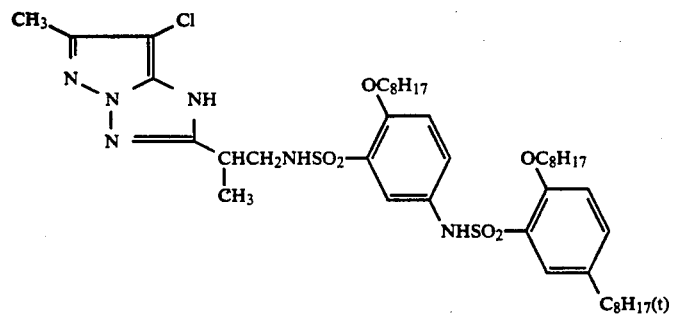
(M-22)
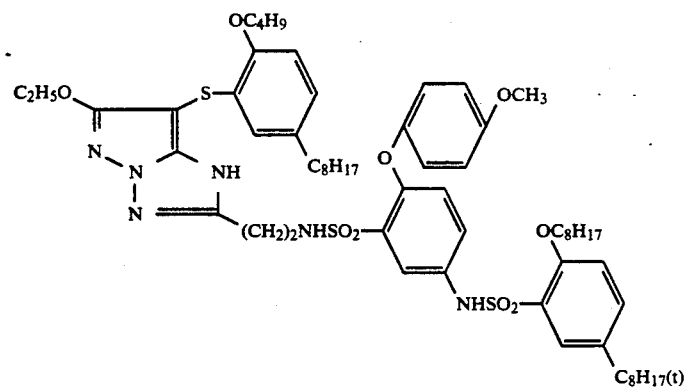

-continued
(M-23)
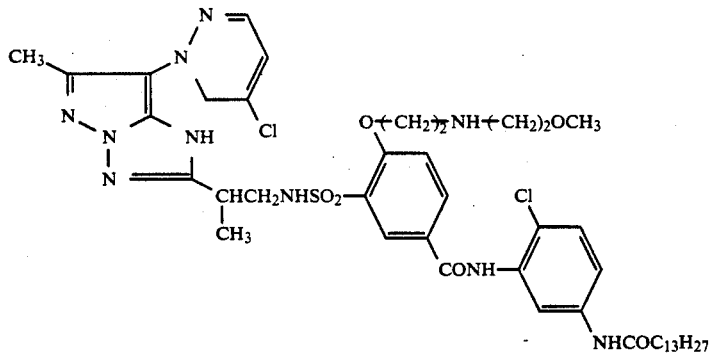
(M-24)
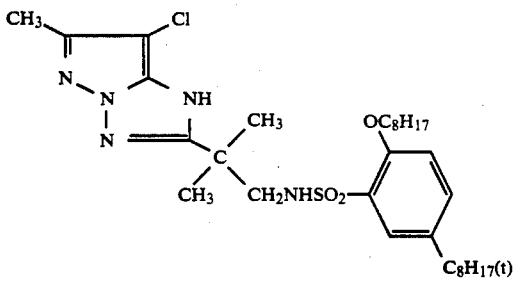
(M-25)
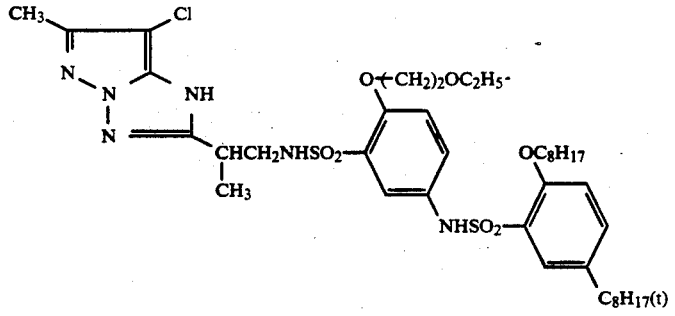
(M-26)
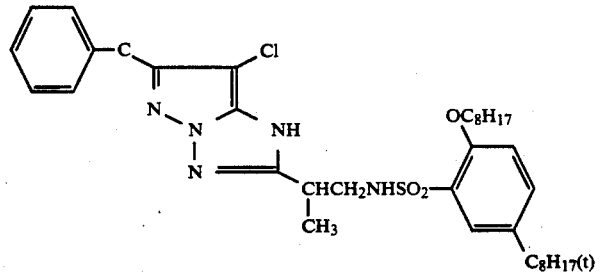
(M-27)
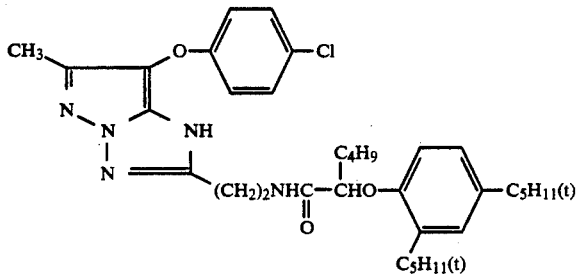

-continued
(M-28)
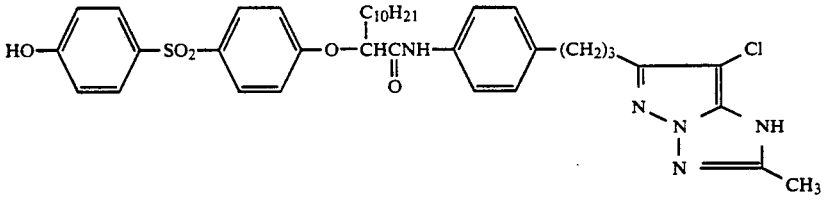
(M-29)
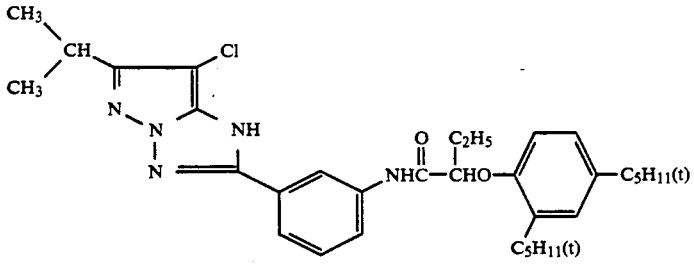
(M-30)
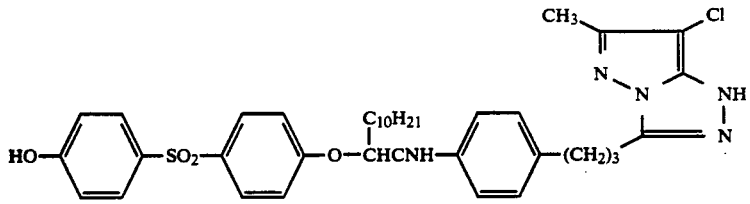
(M-31)
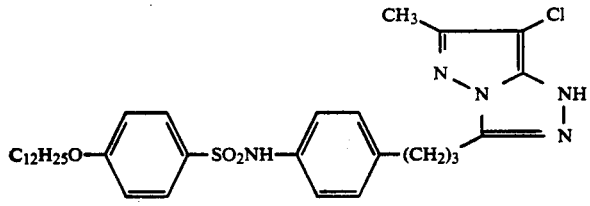
(M-32)
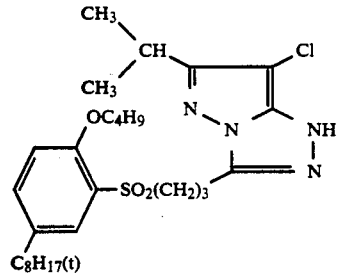
(M-33)
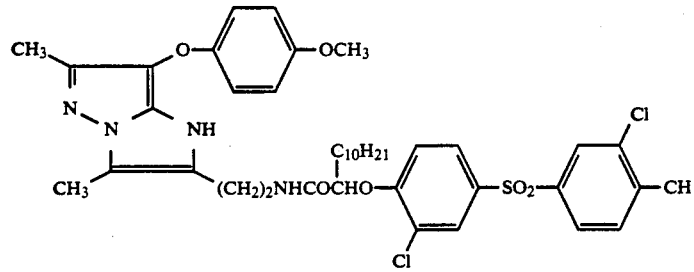

-continued (M-34)

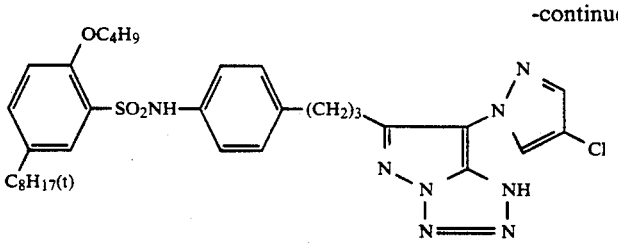

(M-35)

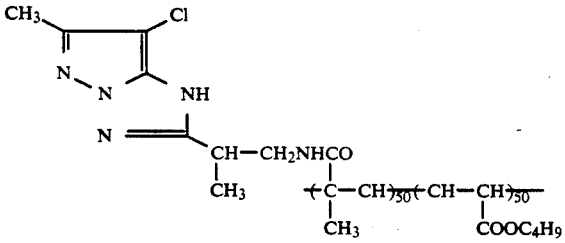

(molar ratio)

(M-36)

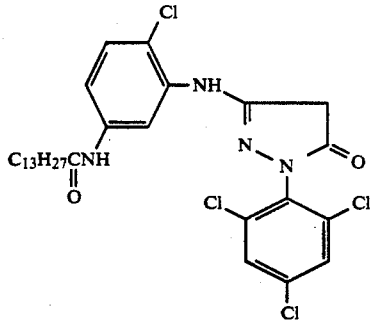

(M-37)

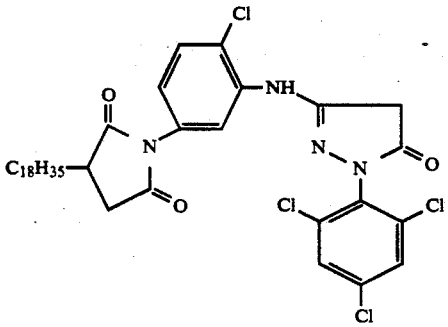

(M-38)

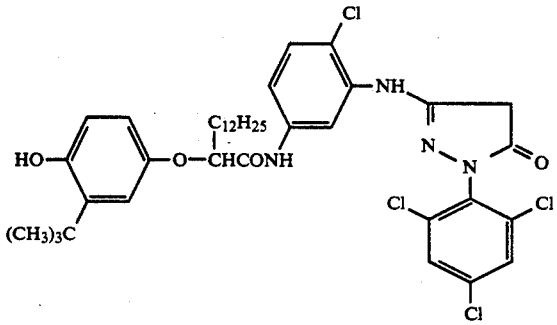

The magenta couplers represented by the general (M-1) and (M-2) can be synthesized by the methods disclosed in U.S. Pat. Nos. 3,725,067, 3,935,015, 4,351,897, 4,540,654 and 4,595,650.

The epoxy compound represented by the general formula (II) is desirably co-emulsified with the yellow coupler of the general formula (I).

Cyan couplers can be used, in addition to the yellow and magenta coupler described above, as couplers in the present invention.

Preferred cyan couplers ares represented by the general formula (C-I).

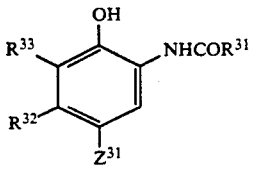

(C-I)

In the formula, $R^{31}$ represents an alkyl group, an aryl group, an amino group or a heterocyclic group; $R^{32}$ represents an acylamino group or an alkyl group. $R^{33}$ represents a hydrogen atom, a halogen atom, an alkyl group or an alkoxy group. Further, $R^{33}$ and $R^{32}$ may be linked to form a ring.

$Z^{31}$ represents a hydrogen atom or a coupling-off

More specifically, in the general formula (C-I), the alkyl group represented by $R^{31}$ preferably represents a linear, branched or cycloalkyl group with 1 to 32 carbon atoms or an aryl group with 6 to 42 carbon atoms. Where $R^{31}$ is an amino group, it includes an alkylamino group or arylamino group and, a phenylamino group which may be substituted is particularly preferred. The alkyl group, aryl group or arylamino group represented by $R^{31}$ may further have a substituent selected from an alkyl group, an aryl group, an alkyl or an aryloxy group, a carboxy group, an alkyl or arylcarbonyl group, an alkyl or aryloxycarbonyl group, an acyloxy group, a sulfamoyl group, a carbamoyl group, a sulfonamido group, an acylamino group, an imido group, a sulfonyl group, a hydroxyl group, a cyano group and a halogen atom. Where $R^{33}$ and $R^{32}$ are linked to form a ring, the ring is preferably a 5- to 7-membered ring, more preferably, an oxyindole ring, a 2-oxobenzoimidaline ring or a carbostyryl ring.

The coupling-off group represented by $Z^{31}$ includesa halogen atom, an alkoxy group, an aryloxy group, an acyloxy group, a sulfonyloxy group, an amido group, an alkoxycarbonyloxy group, an aryloxycarbonyloxy group, an aliphatic thio group, an aromatic thio group, a heterocyclic ring thio group, an imido group, and an N-heterocyclic ring. These releasing groups may contain photographically useful groups. Specific examples of photographically useful groups are groups containing a developer restrainer, developer accelerator or chromophoric group (for example, those having azo bonding).

$R^{31}$, $R^{32}$ or $Z^{31}$ in the general formula (C-I) may form a dimer or higher polymer.

Specific examples of the cyan coupler represented by the general formula (C-I) are shown below, but the present invention is not to be construed as being limited thereto.

(C-1)

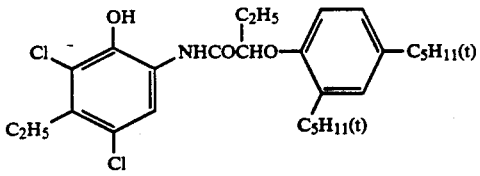

(C-2)

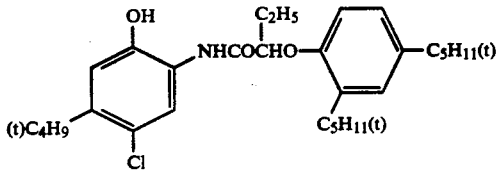

(C-3)

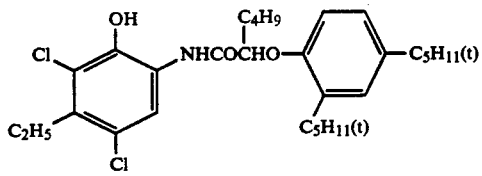

(C-4)

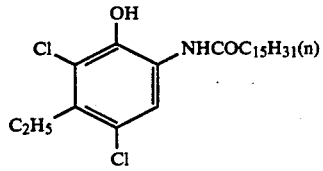

(C-5)

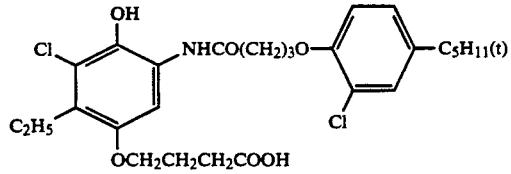

-continued
(C-6)
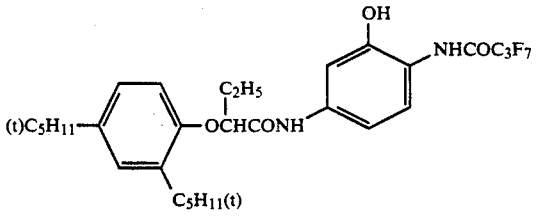
(C-7)
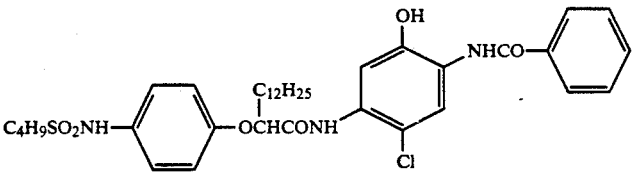
(C-8)
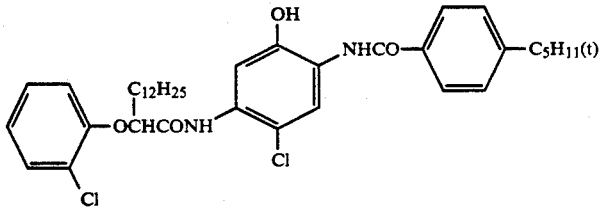
(C-9)
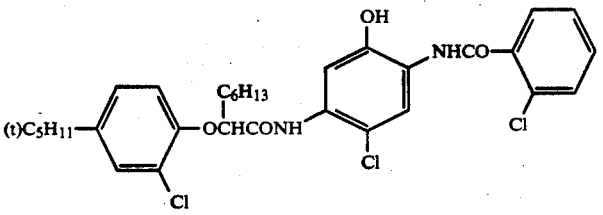
(C-10)
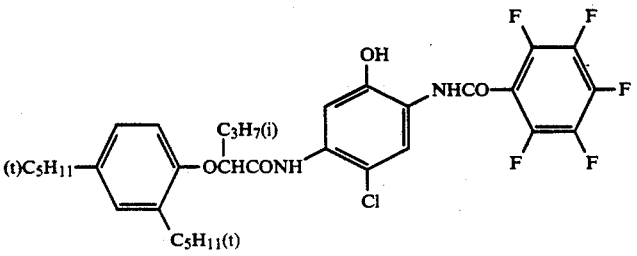
(C-11)
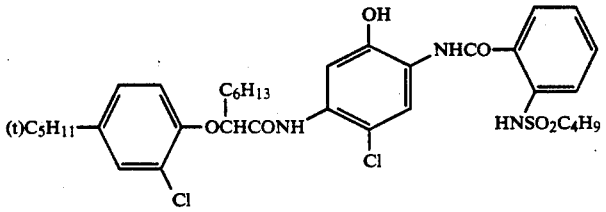
(C-12)
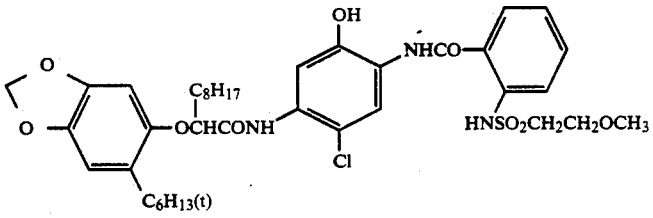

-continued
(C-13)
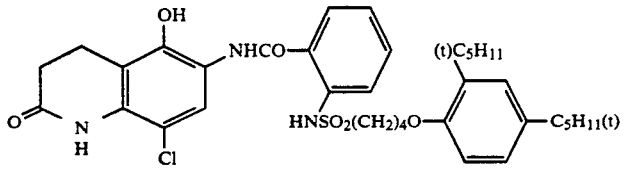
(C-14)
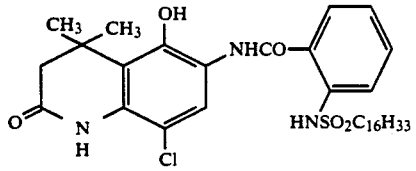
(C-15)
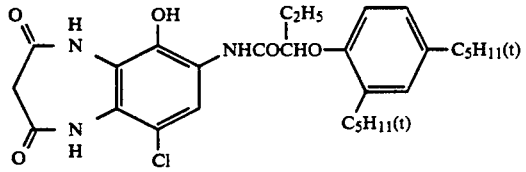
(C-16)
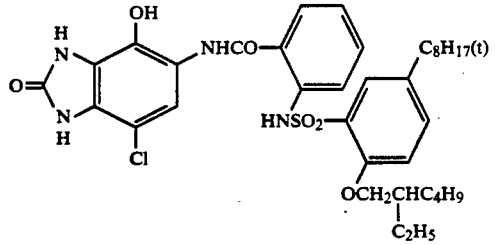
(C-17)
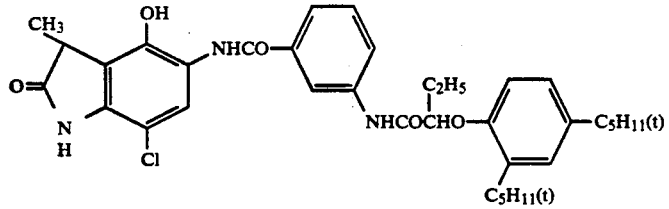
(C-18)
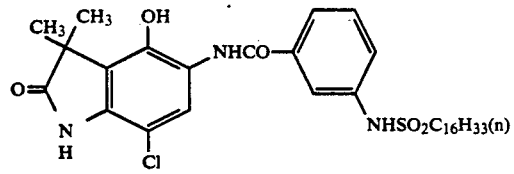
(C-19)
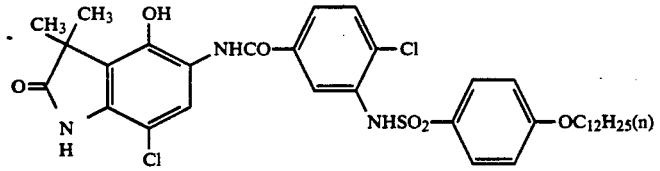
(C-20)
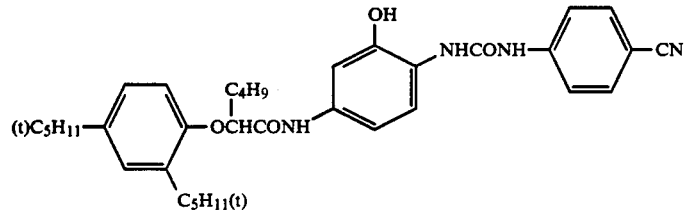

-continued
(C-21)
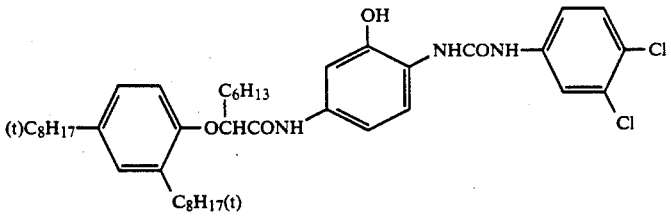
(C-22)
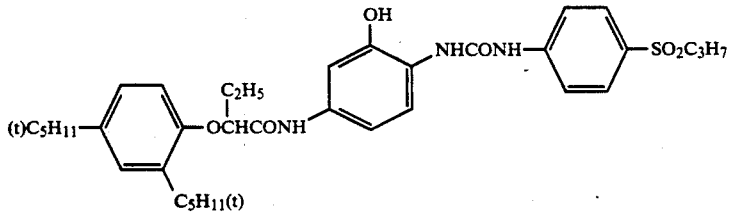
(C-23)
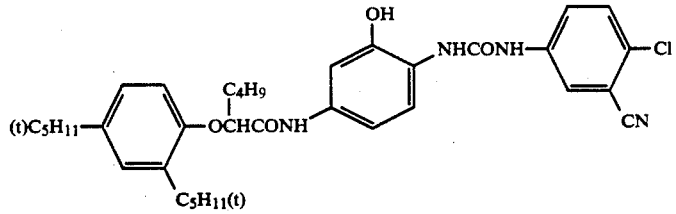
(C-24)
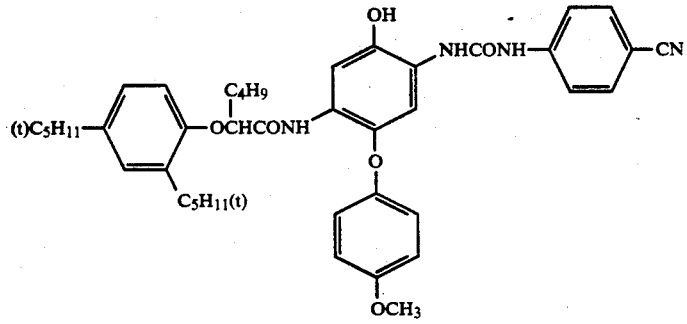
(C-25)
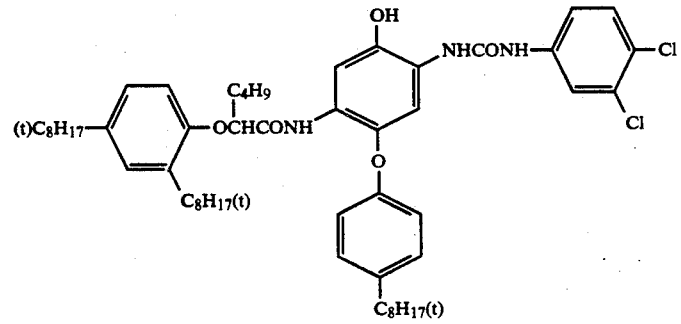
(C-26)
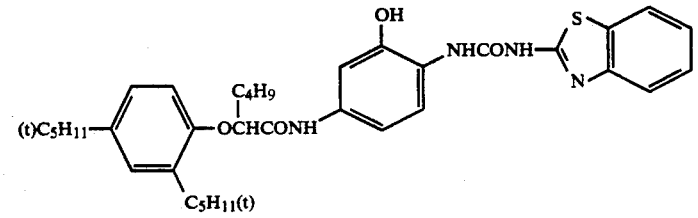

-continued (C-27)

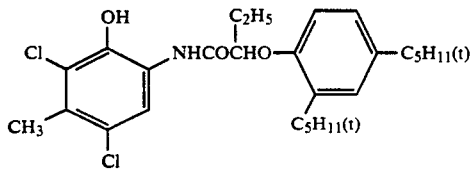

(C-28)

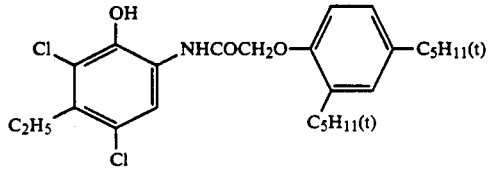

(C-29)

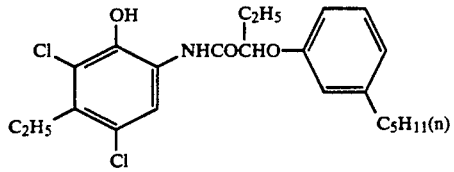

The image stabilizer that can be used together with the compound according to the present invention may any of known discoloration inhibitor, which includes the compounds as described in the following patent publications:

U.S. Pat. Nos. 3,432,300, 3,573,045, 3,574,627, 3,700,455, 3,764,337, 3,935,016, 4,254,216, 4,268,593, 4,430,425, 4,465,757, 4,465,865 and 4,518,679; British Patent No. 1347556; British Patent Application 2066975A; JP-A-52-15225, JP-A-53-17729, JP-A-53-20327, JP-A-54-145530, JP-A-55-6321, JP-A-55-21004, JP-A-61-72246, JP-A-61-73152, JP-A-61-90155, JP-A-61-90156 and JP-A-61-145554.

Typical examples of the image stabilizer are set forth below, but the present invention is not to be construed as being limited thereto.

(F-1)

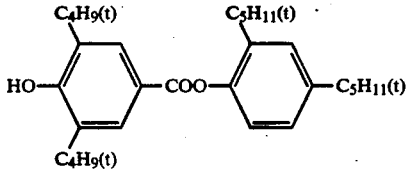

(F-2)

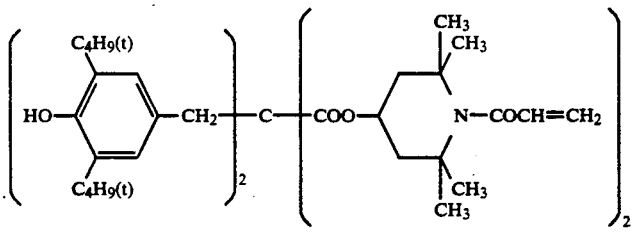

UV-agent mixture (molar ratio: 1:1:1:1)

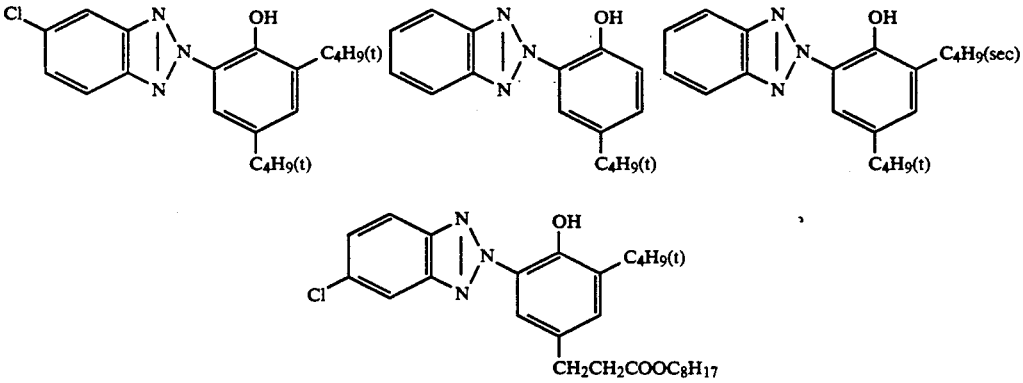

-continued
(F-4)
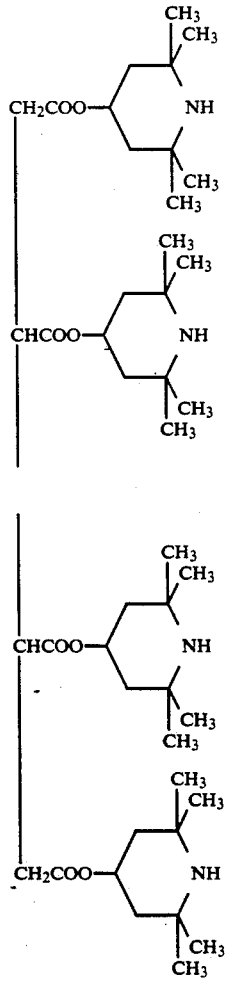
(F-5)
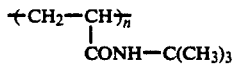
(average molecular weight: 400)
(F-6)
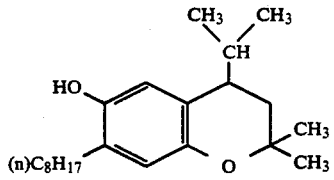
(F-7)
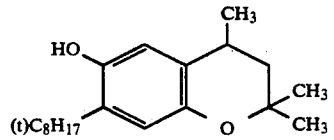
(F-8)
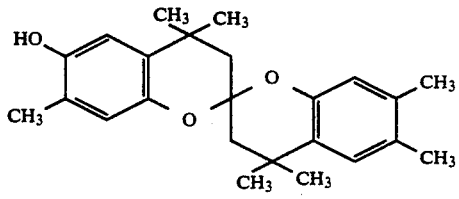

-continued (F-9)

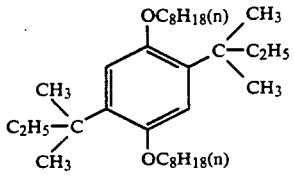

(F-10)

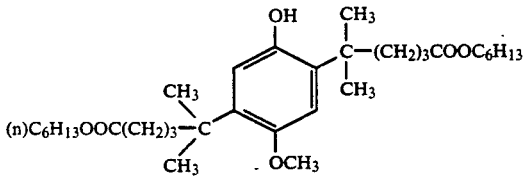

(F-11)

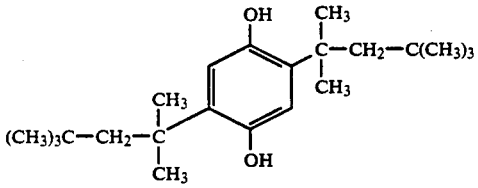

(F-12)

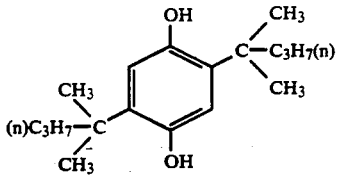

(F-13)

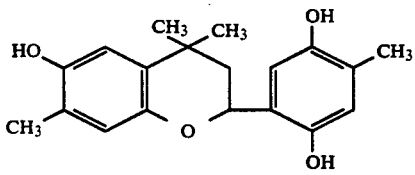

(F-14)

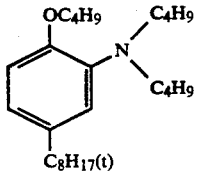

(F-15)

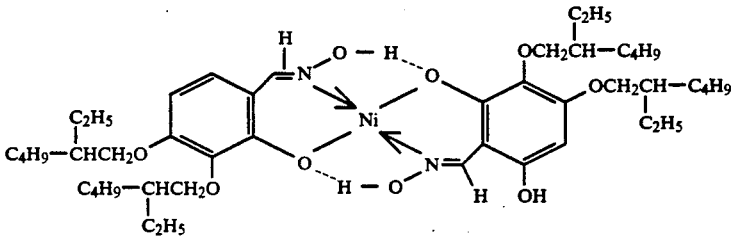

(F-16)

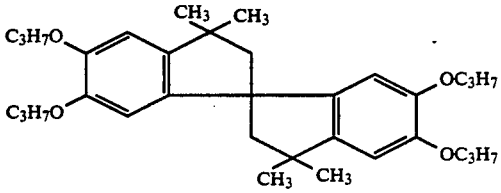

The high boiling point organic solvents useful in the present invention are preferably those having a boiling point higher than 160° C. under normal pressure and they can include, for example, esters (for example, phosphoric acid esters, phthalic acid esters, fatty acid esters and benzoic acid esters), phenols, aliphatic alcohols, carboxylic acids, ethers, amides (for example, aliphatic amides, benzoic acid amides, sulfonic acid amides and cyclic imides), aliphatic hydrocarbons, halogen compounds and sulfone derivatives. When photographic additives such as couplers are added while being dissolved in such high boiling organic solvents, low boiling organic solvents having a boiling point from 30° C. to 160° C. such as lower esters, for example, ethyl acetate, butyl acetate or ethyl propionate, secondary butyl alcohol, methyl isobutyl ketone, cyclohexane, β-ethoxyethyl acetate and dimethylformamide may be mixed as required. These mixtures are used, after being emulsified and dispersed in a hydrophilic aqueous colloidal solution, in admixture with a photographic emulsion. In this case, only the low boiling organic solvent can be removed by concentration under a reduced pressure or water washing.

The amount of the high boiling organic solvent is within a range from 0 to 20 parts by weight, preferably, from 0.2 to 3 parts by weight per 1 part by weight of the photographic additives such as coupler.

Preferred examples of the high boiling organic solvent are set forth below, but the present invention is not to be construed as being limited thereto.

(O-1)

$$O{=}P{\leftarrow}OCH_2\underset{}{\overset{C_2H_5}{\overset{|}{C}}}HC_4H_9)_3$$

(O-2)

$$O{=}P{\leftarrow}OCH_2CH_2\overset{CH_3}{\overset{|}{C}}HCH_2\overset{CH_3}{\overset{|}{\underset{CH_3}{\underset{|}{C}}}}{-}CH_3)_3$$

(O-3)

$$O{=}P{\leftarrow}OC_{12}H_{25})_3$$

(O-4)

$$O{=}P{\leftarrow}OCH_2CH_2OC_4H_9)_3$$

(O-5)

$$O{=}P{\leftarrow}OCH_2CH_2CH_2Cl)_3$$

(O-6)

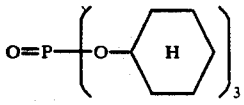

(O-7)

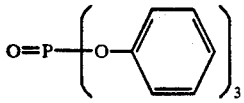

(O-8)

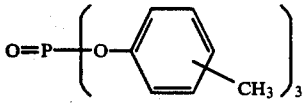

(m, p mixture)

(O-9)

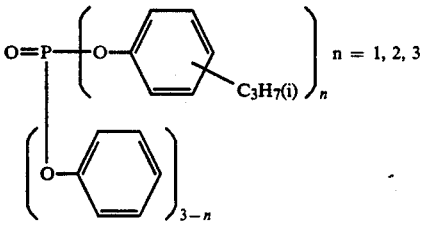

n = 1, 2, 3

(O-10)

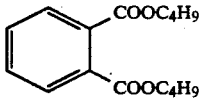

-continued (O-11)

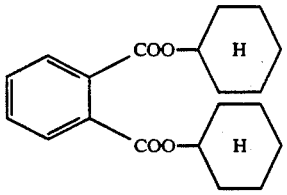

(O-12)

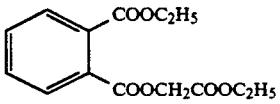

(O-13)

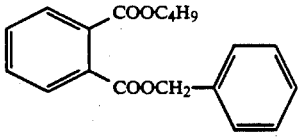

(O-14)

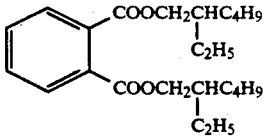

(O-15)

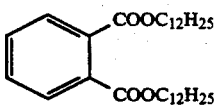

(O-16)

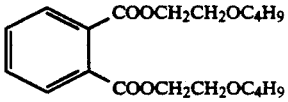

(O-17)

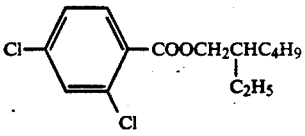

(O-18)

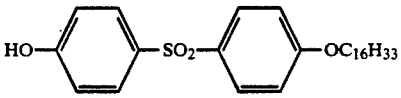

(O-19)

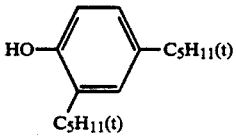

(O-20)

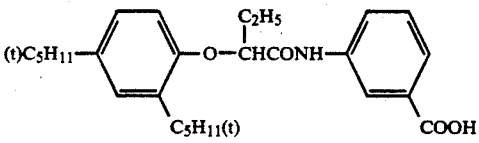

(O-21)

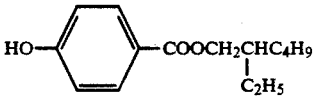

-continued

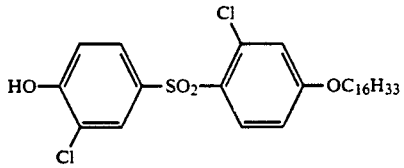
(O-22)

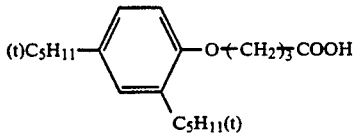
(O-23)

$C_8H_{17}CH{=}CH(CH_2)_7COOC_4H_9$ (O-24)

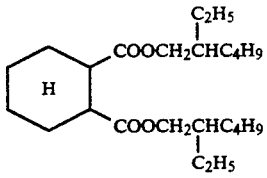
(O-25)

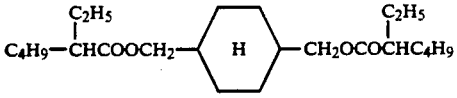
(O-26)

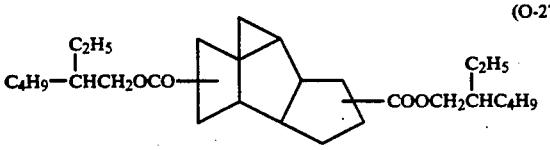
(O-27)

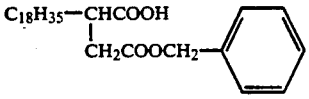
(O-28)

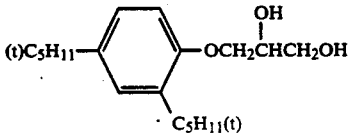
(O-29)

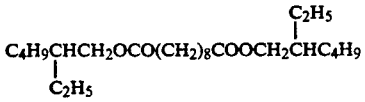
(O-30)

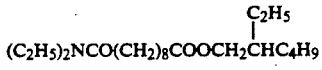
(O-31)

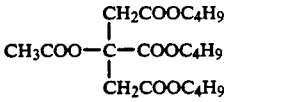
(O-32)

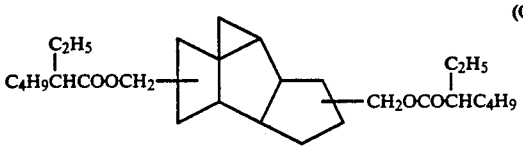
(O-33)

CnH2n + 2 n = 10~20 (O-34)
(paraffin)

-continued $CH_3COCH_2COOC_{12}H_{25}$ (O-35)

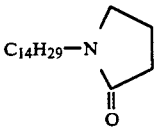
(O-36)

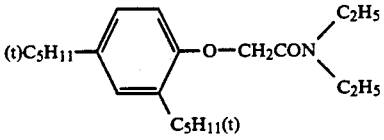
(O-37)

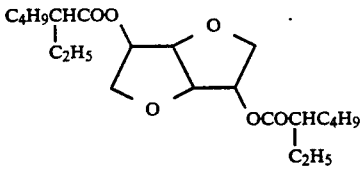
(O-38)

$C_{12}H_{18}Cl_8$ (O-39)
(chlorinated paraffin)

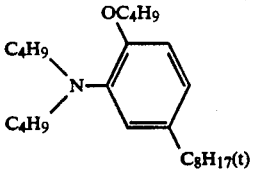
(O-40)

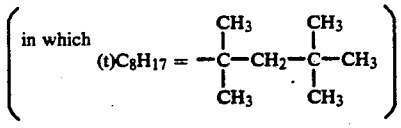

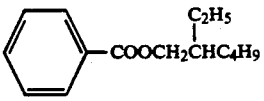
(O-41)

$C_8H_{17}{-}O{-}\underset{\underset{O}{\|}}{C}(CH_2)_8{-}COOC_8H_{17}$ (O-41)

In the present invention, when at least one UV absorber is further used, the effect of the present invention can further be improved.

The UV absorber can be added to any desired layer. Preferably, the UV absorber is incorporated into the layer adjacent to the cyan coupler-containing layer. The UV absorber usable in the present invention includes the group of compounds set forth in *Research Disclosure*, vol 176, No. 17643 (December, 1978) VIII-C and, preferably, benzotriazole derivatives represented by the following general formula (XI).

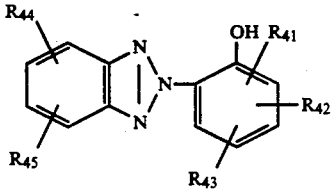
(XI)

where $R_{41}$, $R_{42}$, $R_{43}$, $R_{44}$ and $R_{45}$, which may be the same or different, each represents a hydrogen atom or a substituent. As the substituent, those substituents for the aliphatic group or aryl group represented by $R_1$ in the general formula (II) may be used. $R_{44}$ and $R_{45}$ may be linked to form an aromatic ring containing a 5- or 6-membered carbocyclic ring. These groups or aromatic rings may further be substituted with another substituent.

The compound represented by the general formula (XI) above can be used alone or as a mixture of two or more of them. Examples of typical compound for the UV absorbers usable in the present invention are set forth below, but the present invention is not to be consxtrued as being limited thereto. Among the chemical structures, the skelton

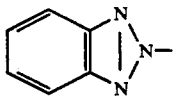

can also have a structure

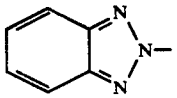

through the resonance structure.

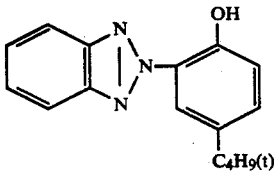

(UV-1)

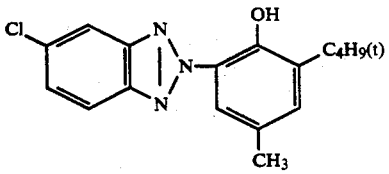

(UV-2)

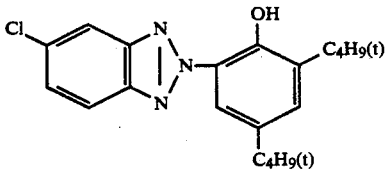

(UV-3)

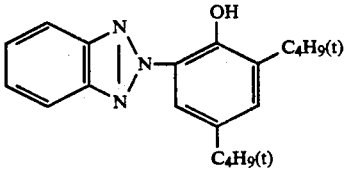

(UV-4)

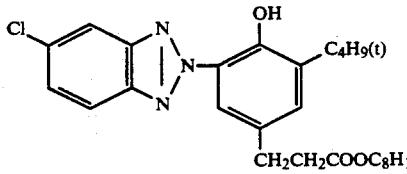

(UV-5)

-continued

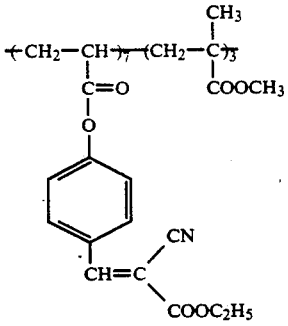

(UV-6)

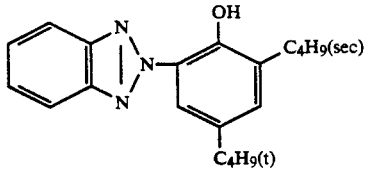

(UV-7)

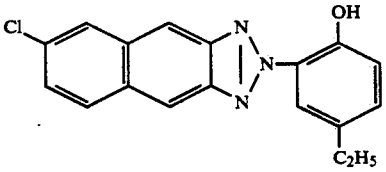

(UV-8)

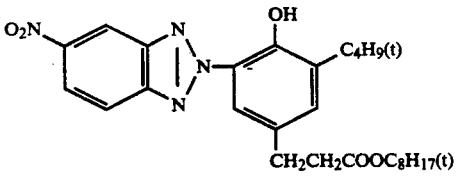

(UV-9)

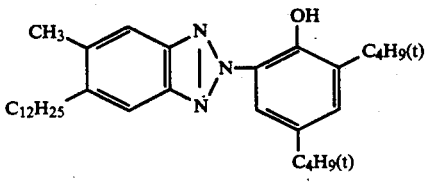

(UV-10)

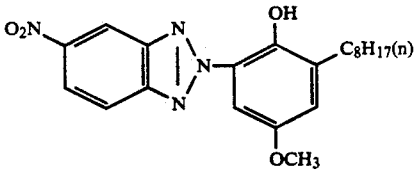

(UV-11)

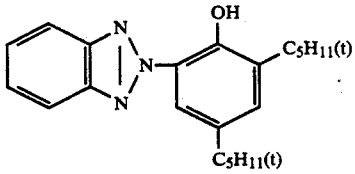

(UV-12)

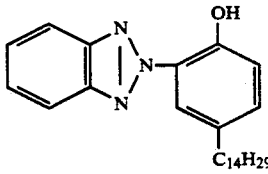

(UV-13)

-continued (UV-14)

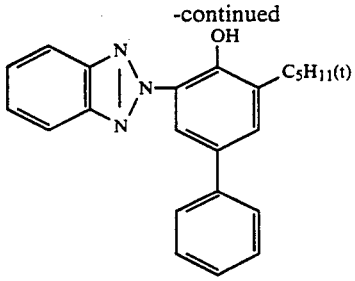

(UV-15)

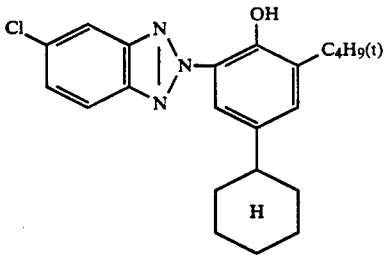

(UV-16)

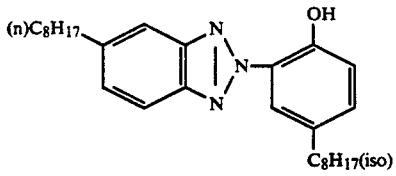

(UV-17)

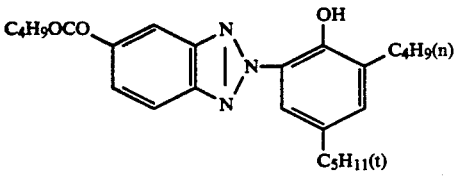

(UV-18)

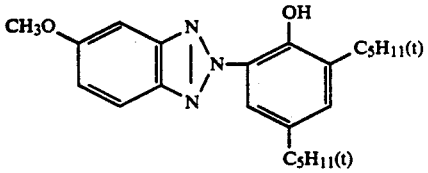

(UV-19)

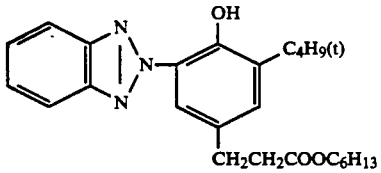

(UV-20)

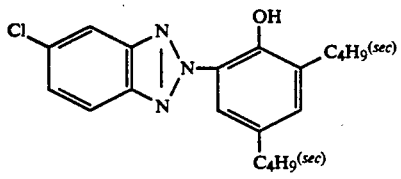

Synthesis processes for the compounds represented by the general formula (XI) or the examples of other compounds are described in, for example, JP-B-44-29620 (the term JP-B as used herein means an "examined published Japanese Patent Application"), JP-A-50-151149 and JP-A-54-95233, U.S. Pat. No. 3,766,205, EP 0057160 and *Research Disclosure,* vol. 225, No. 22519 (1983). Further, high molecular weight UV absorbers as described in JP-A-58-111942 and JP-A-58-178351 (British Patent 2118315A), U.S. Pat. No. 4,455,368, JP-A-59-19945 and JP-A-59-23344 (British Patent 2127569A) can also be used and specific examples include UV-6 above. Low molecular and high molecular UV absorbers can be used in combination.

The UV absorber can be emulsified and dispersed in a hydrophilic colloid by the same method as the coupler. Although there are no particular restrictions for the amount of the high boiling organic solvent and the UV absorber, the high boiling organic solvent is used usually within a range from 0 to 300% based on the weight of the UV absorber. It is preferred to use those compounds which are liquid under ambient temperature alone or in combination.

If the UV absorber of the general formula (XI) is used together with the coupler according to the present invention it is possible to improve the storability, particularly, light fastness of the colored dye image, particularly, cyan image. The UV absorber and the cyan coupler may be co-emulsified.

It is sufficient that the coating amount of the UV absorber is amount sufficient to provide light stability to the cyan dye image, but if it is used in excess, it may result in yellowing in the unexposed area (blank area) of the color photosensitive material and, accordingly, it is usually present within a range preferably from $1\times10^{-4}$ mol/m$^2$ to $2\times10^{-3}$ mol/m$^2$, particularly, from $5\times10^{-4}$ mol/m$^2$ to $1.5\times10^{-3}$ mol/m$^2$.

The dye image stabilizer, stain inhibitor or anti-oxidant usable in the present invention are described in the relevant patents cited in *Research Disclosure* 17643: VII-I-J. Further, the discoloration inhibitor metal complex system is described in *Research Disclosure* 15162.

For the silver halide emulsion layer of the color photosensitive material according to the present invention, various types of silver halides may be used. For example, they include silver chloride, silver bromide, silver bromochloride, silver bromoiodide or silver iodobromochloride. Silver bromide, silver iodobromide containing 2 to 20 mol % of silver iodide and silver chlorobromide containing from 10 to 50 mol % of silver chloride are preferred. There are no particular restrictions as to the crystal form, crystal structure, grain size, grain size distribution, etc. of silver halide grains, but the use of a monodisperse emulsion with a variation coefficient of less than 15% is preferred. The crystal form of the silver halide may be a regular crystal or twin crystal, hexahedron, octahedron or tetradecahedron, but a hexahedron (cube) or tetradecahedron is preferred. As has been described in *Research Disclosure,* vol. 225, No. 22534 (1983), tabular grains with a thickness of not more than 0.5 μm, a diameter of at least 0.6 μm and an average aspect ratio of 5 or greater may be used.

The crystal structure may be uniform or of a composition in which the inner portion and the outer portion are different, or it may be a layered structure, or silver halide grains of different compositions may be joined by an epitaxial bond.

The silver halide emulsion used in the present invention may either be a type for forming latent images mainly on the grain surface or a type for forming latent images mainly on the inside of the grain. In the latter case, a previously unfogged internal latent image type emulsion is useful for forming a direct positive image.

Conventional chemical sensitization, such as sulfur sensitization, can be applied to silver halide emulsion used in the present invention.

The support for use with the present invention includes transparent supports such as polyethylene terephthalate or cellulose triacetate, or reflective supports described below. Reflective supports are preferred and, for example, include barayta paper, polyethylene coated paper, polypropylene type synthesis paper, a transparent support additionally disposed with a reflective layer or used in combination with a reflective material, for example, a glass plate, a polyester film such as one of polyethylene terephthalate, cellulose triacetate or cellulose nitrate, a polyamide film, a polycarbonate film, polystyrene film or a vinyl chloride resin. The supports can properly be selected depending on the purpose.

Generally the photographic material has at least one blue sensitive emulsion layer, at least one green sensitive emulsion layer and at least one red sensitive emulsion layer, and generally, each emulsion layer contains a yellow coupler, a magenta couler, and a cyan coupler, respectively.

The respective blue sensitive, green sensitive and red sensitive emulsions in the present invention are spectrally sensitized by means of methine dye or like other compounds such that they have color sensitivities. The dyes usable herein can include cyanine dyes, merocyanine dyes, complex cyanine dyes, comples merocyanine dyes, holopolar cyanine dyes, hemicyanine dyes, styryl dyes and hemioxonol dyes.

Particularly useful dyes are cyanine dyes, merocyanine dyes and complex merocyanine dyes.

As the color photosensitive material according to the present invention, auxiliary layers, such as a subbing layer, an intermediate layer and a protective layer may be used in addition to the layers described above. In addition, a second UV absorption layer may be disposed between the red sensitive silver halide emulsion layer and the green sensitive silver halide emulsion layer if desired. While the UV absorbers described above are preferably used for the UV absorber layer, other known UV absorbers may also be used.

It is advantageous to use gelatin as the binder or the protective colloid for the photographic emulsion, but other hydrophilic colloids may also be used.

For example, there can be used gelatin derivatives, graft polymers of gelatin with other polymers, proteins such as albumin and casein, cellulose derivatives such as hydroxyethylcellulose, carboxymethylcellulose and cellulose sulfate esters, saccharide derivatives such as sodium alginate and starch derivatives, various synthetic hydrophilic high molecular materials such as homo- or copolymers of vinyl alcohol (including partial acetal of polyvinyl alcohol), N-vinylpyrrolidone, acrylic acid, methacrylic acid, acrylic amide, vinyl imidazole and vinyl pyrazole.

Lime-treated gelatin, as well as acid-processed gelatin or enzyme-processed gelatin as described in *Bull. Soc. Soi. Phot. Japan.* No. 16, p 30 (1966) may be used as gelatin and, alternatively, hydrolysis or enzymatic decomposition products of gelatin may be used.

In the photosensitive material according to the present invention, photographic emulsion layers and other hydrophilic colloid layers may contain brighteners such as stilbene type, triazine type, oxazole, or cumarine type. They may be water soluble brighteners or water insoluble brighteners which may be used in the form of a dispersion. Specific examples of fluorescent brighteners are described, for example, in U.S. Pat. Nos. 2,632,701, 3,269,840, 3,359,102, British Patent 852075 and 1319763, and *Research Disclosure,* vol. 176, 17643 (December, 1978) on page 24, left column, lines 9 to 36.

In the photosensitive material according to the present invention, when dyes or UV absorbers are contained in the hydrophilic colloid layer, they may be mordanted by a cationic polymer. For instance, those polymers described in British Patent 685475, U.S. Pat. Nos. 2,675,316, 2,839,401, 2,882,156, 3,048,487, 3,184,309 and 3,445,231, German Patent Application (OLS) No. 1914362 and JP-A-50-47624 and JP-A-50-71332 can be used.

In addition to the foregoing materials, various photographic additives known in this field, for example, stabilizers, anti-foggants, surface active agents, couplers other than those of the present invention, filter dyes, irradiation inhibiting dyes and developing agents may be added as required to the color photosensitive material according to the present invention, and examples thereof are described in *Research Disclosure,* No. 17643.

Furthermore, fine grain silver halide emulsions having no substantial sensitivity to light (for example, silver chloride, silver bromide and silver bromochloride emulsion with ab average grain size of less than 0.20 μm) may be added to the silver halide emulsion layer or other hydrophilic colloid layer depending on the case.

The color developer usable in the present invention is an aqueous alkaline solution preferably containing an aromatic primary amine color developing agent as the main ingredient. Typical examples of the color developing agent included 4-amino-N,N-diethylaniline, 3-methyl-4-amino-N,N-diethylaniline, 4-amino-N-ethyl N-β-hydroxyethylaniline, 3-methyl-4-amino-N-ethyl-β-hydroxyethylaniline, 3-methyl-4-amino-N-ethyl-N-β-methane sulfonamido ethylaniline and 4-amino-3-methyl-N-ethyl-N-β-methoxyethylaniline.

The color developer can include a pH buffer such as an alkali metal sulfite, carbonate, borate and phosphate, a development inhibitor or antifoggant such as a bromide, an iodide and an organic anti-foggant. Further, if required, the developer may also include a hard water softener, a preservative such as hydroxylamine, ab organic solvent such as benzyl alcohol or diethylene glycol, a development accelerator such as polyethylene glycol, a quaternary ammonium salt and an amine, a color forming coupler, a competitive coupler, a fogging agent such as sodium boron hydride, an auxiliary liquid developer such as 1-phenyl-3-pyrazolidone, a tackifier, a polycarboxylic acid type chelating agent as described in U.S. Pat. No. 4,083,723 and an anti-oxidant as described in German Patent Application (OLS) 2622950.

However, when adding benzyl alcohol to the color developer, it is added preferably in an amount not more than 2.0 ml/liter and, more preferably, not more than 0.5 ml/liter. It is most preferred that the benzyl alcohol be added. The color developing time is preferably from 30 second to 2 minutes 30 second and, more preferably, from 45 second and to 2 minutes.

The photographic emulsion layer after color development is usually bleached. The bleaching may be at the same time as the fixing treatment or independently. The bleaching agent can include, for example, compounds of polyvalent metals such as iron (III), cobalt (III), chromium (IV) and copper (II), peracids, quinones and nitroso compounds, for instance, ferricyanides, bichromates, organic complex salts of iron (III) or cobalt (III), for example, complex salts of ethylenediamine tetraacetic acid, nitrilo triacetic acid, aminopolycarboxylic acid such as 1,3-diamino-2-propanol tetraacetic acid or organic acids such as citric acid, tartaric acid or maleic acid; persulfates, permanganates and nitrosophenol. Among them, potassium ferricyanide, iron (III) sodium ethylenediamine tetraacetate and iron (III) ammonium ethylenediamine tetraacetate are particularly useful. Iron (III) complex salt of ethylenediamine tetraacetic acid is useful in a separate bleaching solution or bleach fix solution in a single bath.

Water washing may be applied after color development or bleaching fixing treatment. Color development can be conducted at an optional temperature between 18° and 55° C. Color development is carried out at a temperature preferably not lower than 30° C. and, particularly preferably not lower than 35° C. The time required for development is within a range from about 3 and one-half minutes to about one minutes, the shorter time being preferred. Liquid replenishment is preferred for continuous development methods and in an amount generally not more than 330, preferably, not more than 160 ml, and more preferably, not more than 100 ml per one square meter of the material to be treated. Benzyl alcohol in the liquid developer is preferably not more than 5 ml/l.

While the bleach-fixing can be performed at an optional temperature from 18° C. to 50° C., a temperature not lower than 30° C. is preferred. If 35° C. or higher, the processing time can be shortened to less than one minute and the amount of the replenishing liquid can be decreased. The time required for water washing after the color development or bleach-fixing is usually within 3 minutes and the water washing can substantially be eliminated by using a stabilization bath.

The colored dye is deteriorated or discolored by fungi during preservation, in addition to degradation with light, heat or temperature. Since the cyan image suffers from significant fungal degradation, it is preferred to use a fungicide. Specific examples of fungicide include 2-thiazolyl benzoimidazoles as described in JP-A-57-157244. The fungicide may be incorporated in the photosensitive material or may be added externally at the developing step. Alternatively, it may be added in any of the steps if it can be present together with the photosensitive material.

The present inventiobn is illustrated in greater detail with reference to the following examples which are not to be construed as limiting the scope of the present invention. Unless otherwise indicated, all parts, percents and ratios are by weight.

EXAMPLE 1

A multi-layered color print paper A of the layer structure shown below was prepared on a paper support having polyethylene laminates on both sides thereof. The coating solution was prepared as described below.

Preparation of first layer coating solution 27.2 ml of ethyl acetate, and 7.7 ml of a solvent (Solv-1) were added to and dissolved 10.65 g of yellow coupler (ExY-1) and 8.11 g of yellow coupler (ExY-2) and 4.4 g of color image stabilizer (Cpd-1), and the solution was emulsified and dispersed in 185 ml of a 10% aqueous gelatin solution containing 8 ml of 10% sodium dodecylbenzene sulfonate. Separately, an emulsion was prepared by adding a blue sensitive sensitization dye shown below in an amount of $5.0\times10^{-4}$ mol per mol of silver to a monodisperse cubic silver bromochloride emulsion (80.0 mol % of silver bromide, 1.1 μm in grain size and having a 10% variation coefficient). The emulsified dispersion and the emulsion were mixed to prepare a first layer coating liquid having the composition as described below. The coating liquids for the second layer to the seventh layer were prepared in the same manner as the first layer coating solution. 2-Hydroxy-4,6-dichloro-s-triazine sodium salt was used as a gelatin hardener for each of the layers.

The following spectral sensitization dyes were used for the respective layers.

Blue sensitive emulsion layer

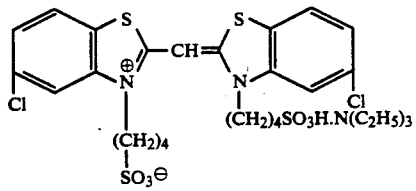

($5.0\times10^{-4}$ mol per mol of silver halide)

Green sensitive emulsion layer

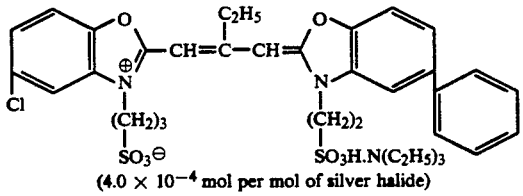

($4.0\times10^{-4}$ mol per mol of silver halide)

and,

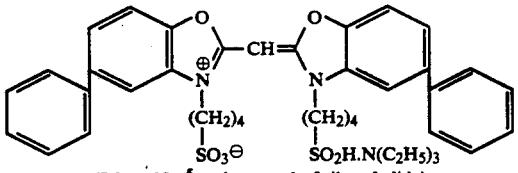

($7.0\times10^{-5}$ mol per mol of silver halide)

Red sensitive emulsion layer

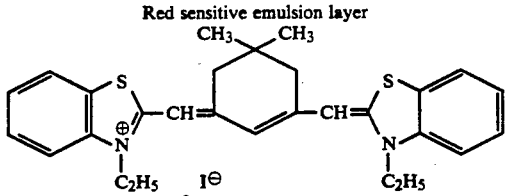

($0.9\times10^{-5}$ mol per mol of silver halide)

The following compound was added in an amount of $2.6\times10^{-3}$ mol per mol of silver halide to the red sensitive emulsion layer as a supersensitizing dye.

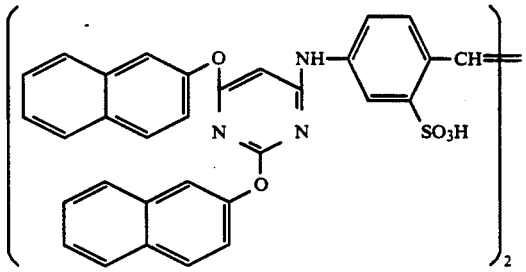

Further, to the blue sensitive emulsion layer, the green emulsion layer and the red sensitive emulsion layer, 1-(5-methylureidophenyl)-5-mercaptotetrazole was added in an amounts of $4.0\times10^{-6}$ mol, $3.0\times10^{-5}$ mol and $1.0\times10^{-5}$ mol per mol of silver halide, respectively.

Furthermore, to the blue sensitive emulsion layer and the green sensitive emulsion layer, 4-hydroxyl-6-methyl-1,3,3a,7-tetraazaindene was added in amounts of $1.2\times10^{-2}$ mol and $1.1\times10^{-2}$ mol per mol of silver halide, respectively.

For the prevention of irradiation, the following dyes were added to the emulsion layer.

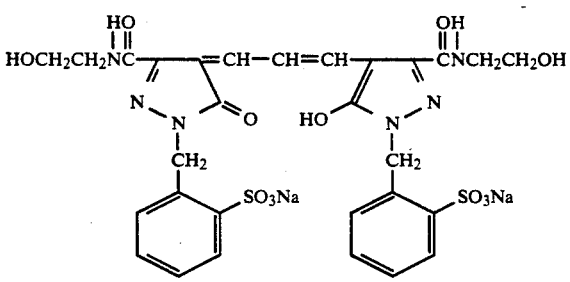

and

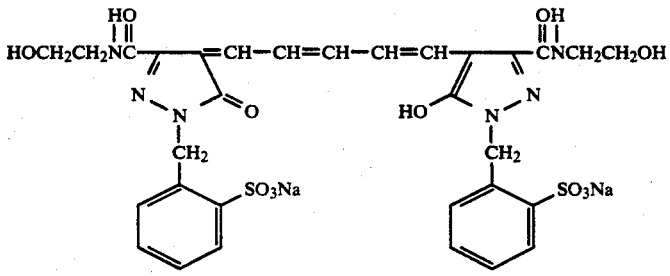

Layer Structure

The composition for each of the layers is shown below. The numbers represent the coating mount (g/m$^2$). The amount of silver halide emulsion is expressed as the coating amount calculated as silver.

Support

Polyethylene laminated paper (Containing white pigment ($TiO_2$) and blue tinted dye (marine blue) in the polyethylene on the side of the first layer).

| | |
|---|---|
| First layer (Blue sensitive layer) | |
| Silver halide emulsion (Br: 80% average grain side: 1.1 μm, variation coefficient 0.10, cubic) | 0.26 |
| Gelatin | 1.83 |
| Yellow coupler (ExY1) | 0.45 |
| Yellow coupler (ExY2) | 0.35 |
| Solvent (Solv-1) | 0.35 |
| Color image stabilizer (Cpd-1) | 0.08 |
| Second layer (Color mixing preventive layer) | |
| Gelatin | 0.99 |
| Color mixing inhibitor (Cpd-2) | 0.08 |
| Third layer (Green sensitive layer) | |
| Silver halide emulsion (Br: 80% average grain size: 0.43 μm, variation coefficient 0.10, cubic) | 0.16 |
| Gelatin | 1.79 |
| Magenta coupler (ExM1) | 0.32 |
| Color image stabilizer (Cpd-1) | 0.10 |
| Color image stabilizer (Cpd-3) | 0.20 |
| Color image stabilizer (Cpd-4) | 0.05 |
| Solvent (Solv-2) | 0.65 |
| Fourth layer (UV absorption layer) | |
| Gelatin | 1.58 |
| UV absorber (UV-1) | 0.62 |
| Color mixing inhibitor (Cpd-5) | 0.05 |
| Solvent (Solv-5) | 0.24 |
| Fifth layer (Red sensitive layer) | |
| Silver halide emulsion (Br: 70% average grain size: 0.55 μm, variation coefficient 0.13, cubic) | 0.23 |
| Gelatin | 1.34 |
| Cyan coupler (ExC) | 0.24 |
| Color mixing inhibitor (Cpd-5) | 0.01 |
| Color mixing inhibitor (Cpd-8) | 0.01 |
| Color image stabilizer (Cpd-6) | 0.17 |
| Color image stabilizer (Cpd-7) | 0.30 |
| Solvent (Solv-3) | 0.14 |
| Solvent (Solv-4) | 0.14 |
| Sixth layer (UV absorption layer) | |
| Gelatin | 0.53 |
| UV absorber (UV-1) | 0.21 |
| Solvent (Solv-5) | 0.08 |
| Seventh layer (Protective layer) | |
| Gelatin (acid treated) | 1.33 |
| Polyvinyl alcohol acryl modified copolymer (modification degree 17%) | 0.17 |
| Liquid paraffin | 0.03 |

(Note): The average grain size of the emulsion used above is the average for the ridge length and the variation coefficient is the ratio ($s/\bar{d}$) in which (s) represents the statistical standard deviation and ($\bar{d}$) represents the average grain size.

Yellow coupler

-continued
ExY1
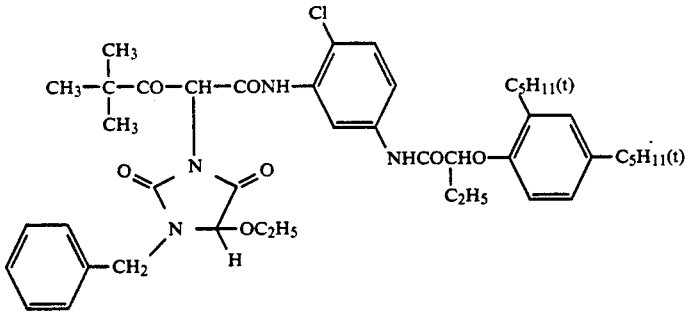
ExY2
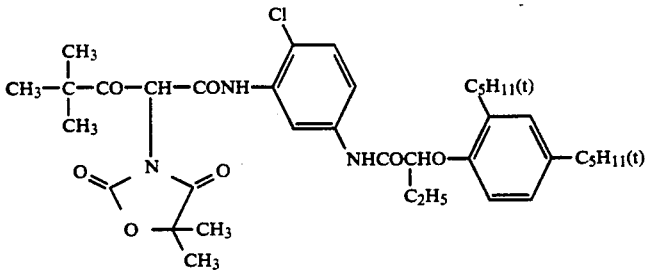
ExY3
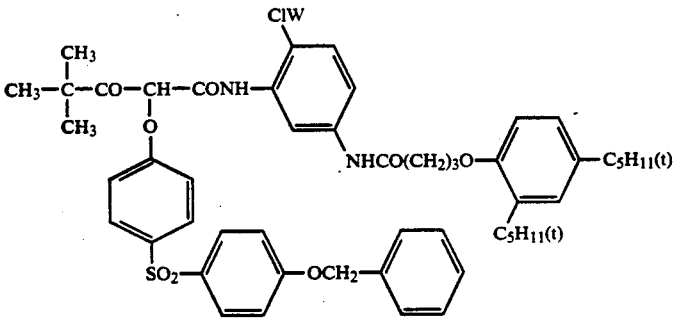
Magenta coupler
ExM1
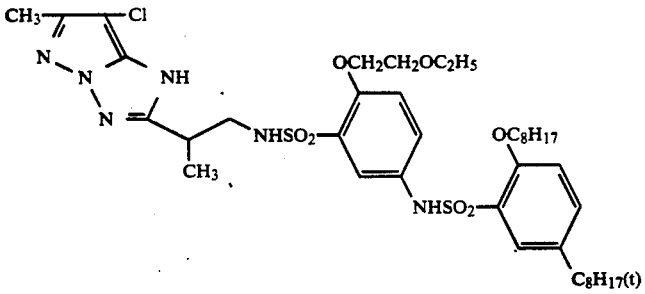
ExM2
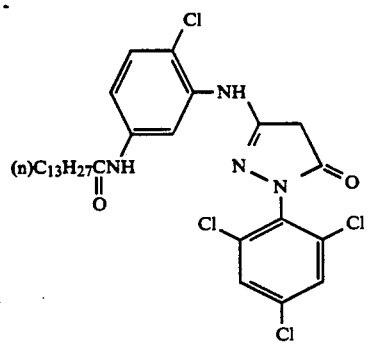

-continued
ExM3
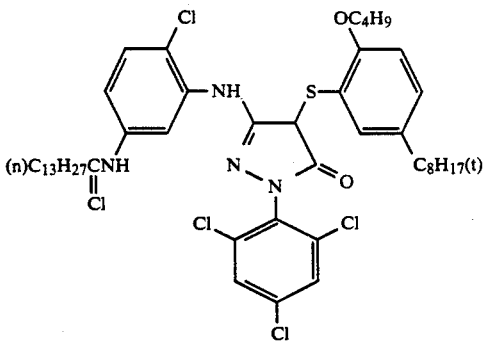
Cyan coupler
ExC
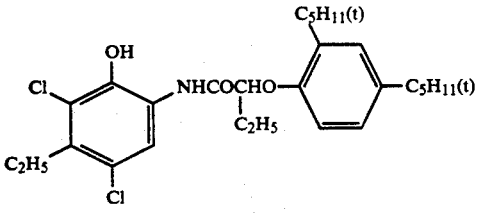
(Cpd-1) Color image stabilizer
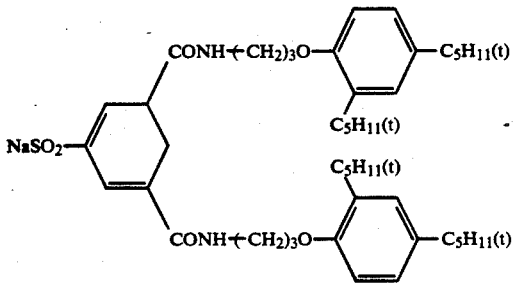
(Cpd-2) Color mixing inhibitor
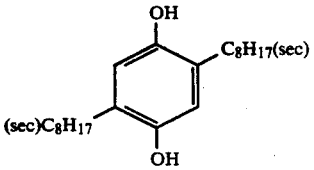
(Cpd-3) Color image stabilizer
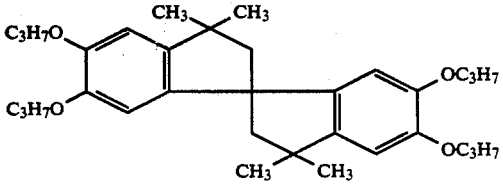
(Cpd-4) Color image stabilizer
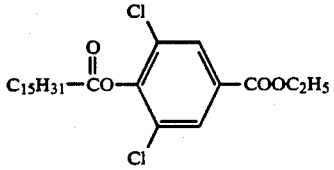
(Cpd-5) Color mixing inhibitor -continued
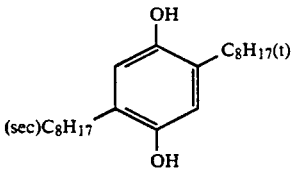
(Cpd-6) Color image stabilizer
A 5:8:9 mixture (weight ratio) of
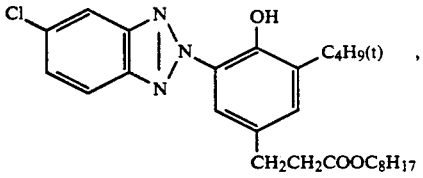
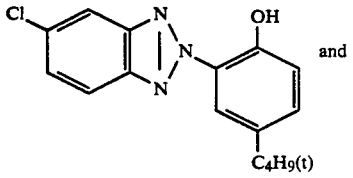
and
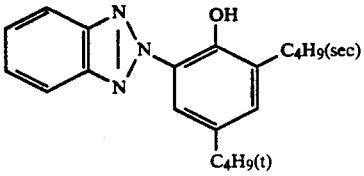
(Cpd-7) Polymer
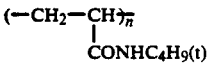
Average molecular weight: 50,000
(Cpd-8) Color mixing inhibitor
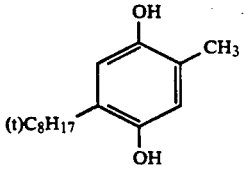
(UV-1) UV absorber
a 2:9:8 mixture (weight ratio) of
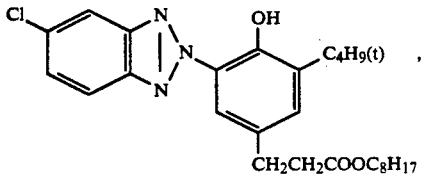
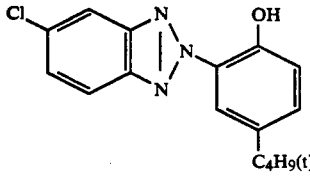
and -continued

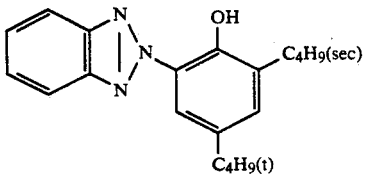

(Solv-1) solvent

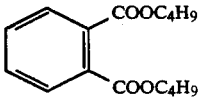

(Solv-2) solvent

A 2:1 mixture (volume ratio) of

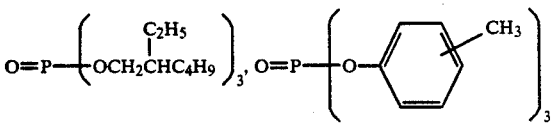

(Solv-3) solvent
$O{=}P{\leftarrow}O{=}C_9H_{19}(iso))_3$ (Solv-4) Solvent

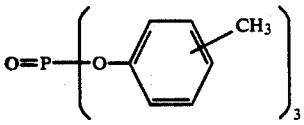

(Solv-5) Solvent
$C_8H_{17}OOC{\leftarrow}CH_2{\rightarrow}_8COOC_8H_{17}$

Furthermore, color print papers (B) to (N) shown in Table 1 were prepared by replacing the yellow coupler used in the first layer with various yellow couplers in an equimolar amount as described for the examples of the coupler in the present invention and also by adding various epoxy compounds according to the present invention.

TABLE 1

| Color print paper | First layer: Yellow coupler | First layer: Epoxy compound (addition amount ratio to coupler) | First layer: Solvent (addition amount ratio to coupler) | Third layer magenta coupler | Remarks |
|---|---|---|---|---|---|
| A | ExY-1/ExY-2 | — | Solv-1 0.41 (ml/g) | ExM-1 | Comparison |
| B | " | Exemplified compound (II-I) 0.40 (g/g) | — | " | This invention |
| C | " | Exemplified compound (II-I) 0.20 | Solv-1 0.21 | " | This invention |
| D | " | Exemplified compound (II-5) 0.40 | — | " | This invention |
| E | " | Exemplified compound (II-5) 0.30 | Solv-4 0.10 | (M-1) | This invention |
| F | " | Exemplified compound (II-9) 0.30 | Solv-5 0.10 | " | This invention |
| G | " | Exemplified compound (II-12) 0.20 | Solv-1 0.20 | (M-15) | This invention |
| H | " | Exemplified compound (II-18) 0.20 | Solv-1 0.20 | (M-16) | This invention |
| I | (I-3) | — | Solve-1 0.40 | (M-36) | Comparison |
| J | (I-3) | Exemplified compound (II-5) 0.20 | Solv-1 0.21 | (M-25) | This invention |
| K | (I-4) | Exemplified compound | Solv-5 | (M-25) | This |

TABLE 1-continued

| Color print paper | First layer Yellow coupler | Epoxy compound (addition amount ratio to coupler) | Solvent (addition amount ratio to coupler) | Third layer magenta coupler | Remarks |
|---|---|---|---|---|---|
| | | (II-12) 0.20 | 0.20 | | invention |
| L | (I-6) | Exemplified compound (II-5) 0.30 | Solve-5 0.10 | M-32) | This invention |
| M | (I-6) | Exemplified compound (II-5) 0.30 | Solve-4 0.10 | (M-32) | This invention |
| N | ExY-3 | Exemplified compound (II-5) 0.20 | Solv-1 0.21 | (M-36) | Comparison |

The print papers (A) to (N) were subjected to gradation exposure for sensitometry by using a sensitometer (FWH type, manufactured by Fuji Photo Film Co., Ltd.), color temperature at light source: 3,200° K., through each of blue, green and red filters. Exposure in this case was conducted so as to give an exposure amount of 250 CMS with an exposure time of 1/10 sec.

After exposure, the following procedure of color development, bleach-fixing and water washing was carried out.

| Processing step | Temperature | Time |
|---|---|---|
| Color development | 38° C. | 1 min 40 sec |
| Bleach-Fix | 30–34° C. | 1 min 00 sec |
| Rinsing (1) | 30–34° C. | 20 sec |
| Rinsing (2) | 30–34° C. | 20 sec |
| Rinsing (3) | 30–34° C. | 20 sec |
| Drying | 70–80° C. | 50 sec |

(3-vessel countercurrent system from ringing (3)→(1) was employed)

The composition for each of the processing solutions was as follows.

| | |
|---|---|
| Color developer | |
| Water | 800 ml |
| Diethylenetriamine pentaacetic acid | 1.0 g |
| Nitrotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-ethyl-N-(β-methanesulfonamidoethyl)-3-methyl-4-aminoaniline sulfate | 5.0 g |
| Hydroxylamine sulfate | 4.0 g |
| Fluorescent brightener (WHITEX 4B, manufactured by Sumitomo Chemical) | 1.0 g |
| made up with water to | 1000 ml |
| pH (25° C.) | 10.20 |
| Bleach-fixing solution | |
| Water | 400 ml |
| Ammonium thiosulfate (70%) | 200 ml |
| Sodium sulfite | 20 g |
| Iron (III) ammonium ethylenediamine tetraacetate | 60 g |
| Disodium ethylenediamine tetraacetate | 10 g |
| made up with water to | 1000 ml |
| pH (25° C.) | 7.00 |
| Rinsing solution | |

Ion exchanged water (calcium, magnesium, each not more than 3 ppm)

Tests were conducted for light storability and dark heat storability for each of the samples having a color dye image formed by the above procedures, by the following procedures (a) and (b).

(a) Light storability

Xenon fade meter $5\times10^4$ Lux

Irradiated for 10 days (b) Dark heat storability

100° C. with no humidification, 5 days

The storability of the dye image was represented by the percentage (%) of the density (D) after the test relative to the initial density (DO)=1.0.

The results are shown in Table 2.

TABLE 2

| Color print paper | Light storability Y | Light storability M | Dark heat storability Y | Dark heat storability M | Remark |
|---|---|---|---|---|---|
| A | 82 | 90 | 79 | 96 | Comparison |
| B | 90 | 91 | 94 | 95 | This invention |
| C | 91 | 91 | 95 | 96 | This invention |
| D | 92 | 91 | 93 | 95 | This invention |
| E | 89 | 89 | 93 | 95 | This invention |
| F | 90 | 89 | 94 | 94 | This invention |
| G | 92 | 93 | 94 | 96 | This invention |
| H | 91 | 92 | 93 | 95 | This invention |
| I | 73 | 81 | 76 | 95 | Comparison |
| J | 91 | 90 | 95 | 96 | This invention |
| K | 91 | 91 | 96 | 96 | This invention |
| L | 90 | 88 | 91 | 92 | This invention |
| M | 84 | 86 | 91 | 91 | This invention |
| N | 72 | 80 | 73 | 94 | Comparison |

As is apparent from Table 2, in the color print paper not using the epoxy compound according to the present invention, the light and dark heat storability of the yellow image was remarkably deteriorated, but it can be seen that the light and dark heat storability of the yellow image was improved by using the epoxy compound according to the present invention. It can be seen that good balance was obtained between yellow and magenta color image discoloration.

In specimen N, the epoxy compound according to the present invention was not effective for light and heat fastness of the yellow image formed from the aryloxy releasing yellow coupler.

Then, print papers O and P were prepared by replacing, in the print papers A and B described above, the emulsions in each of the layers with the following cubic silver bromochloride emulsion containing from 0.4 to 1 mol % of silver bromide, and the spectral sensitization dye used in the blue sensitive layer, green sensitive layer and red sensitive layer, respectively, with the following compounds, respectively.

| | Cubic silver bromochloride emulsion | | |
|---|---|---|---|
| | Average grain size | Variation coefficient | Silver bromide content |
| Blue sensitive layer | 0.97 μm | 0.13 | 0.7 mol % |
| Green sensitive layer | 0.39 μm | 0.12 | 0.4 mol % |
| Red sensitive layer | 0.48 μm | 0.09 | 1.0 mol % |

Blue sensitive emulsion layer

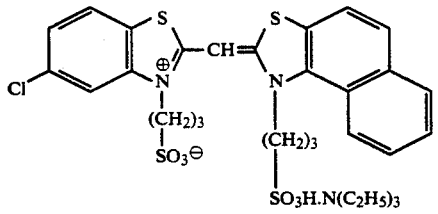

(added by $7 \times 10^{-4}$ mol per mol of silver halide)

Green sensitive emulsion layer

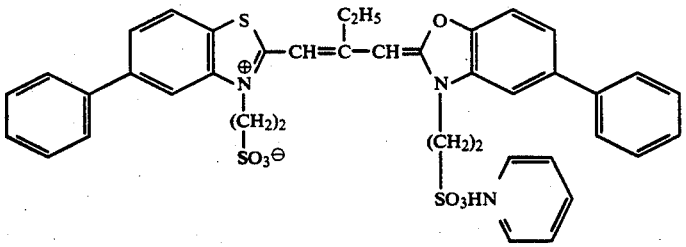

(added by $4 \times 10^{-4}$ mol per mol of silver halide)

Red sensitive emulsion layer

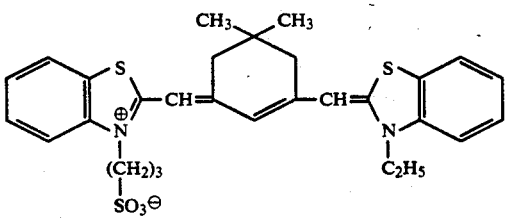

(added by $2 \times 10^{-4}$ mol per mol of silver halide)

After the same gradation exposure as for the specimens (A) and (B) was given to prints O and P, processing by the following color development, bleach-fixing and stabilization steps was applied.

| Processing step | Temperature | Time |
|---|---|---|
| Color development | 35° C. | 45 sec |
| Bleach-Fix | 30–36° C. | 45 sec |
| Rinsing (1) | 30–37° C. | 20 sec |
| Rinsing (2) | 30 37° C. | 20 sec |
| Rinsing (3) | 30–37° C. | 20 sec |
| Rinsing (4) | 30–37° C. | 30 sec |
| Drying | 70–85° C. | 60 sec |

(a 4-vessel countercurrent system from rinsing (4)→(1) was employed)

The composition for each of the processing solutions was as follows.

Color development

| | |
|---|---|
| Water | 800 ml |
| Ethylenediamine tetraacetic acid | 2.0 g |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline sulfate | 5.0 g |
| N,N-diethylhydroxylamine | 4.2 g |
| 5,6-dihydroxybenzene-1,2,4-trisulfonic acid | 0.3 g |
| Fluorescent brightener (4,4'-diamino stilbene type) | 2.0 g |
| made up with water to | 1000 ml |
| pH (25° C.) | 10.10 |

Bleach-fixing solution

| | |
|---|---|
| Water | 400 ml |
| Ammonium thiosulfate (70%) | 100 ml |
| Sodium sulfite | 18 g |
| Iron (III) ammonium ethylenediamine tetraacetate | 55 g |
| Disodium ethylenediamine tetraacetate | 3 g |
| Glacial acetic acid | 8 g |
| made up with water to | 1000 ml |
| pH (25° C.) | 5.5 |

Stabilization solution

| | |
|---|---|
| Formalin (37%) | 0.1 g |

-continued

| | |
|---|---|
| Formalin-sulfurous acid adduct | 0.7 g |
| 5-Chloro-2-methyl-4-isothiazolin-3-one | 0.02 g |
| 2-Mthyl-4-isothiazolin-3-one | 0.01 g |
| Copper sulfate | 0.005 g |
| made up with water to | 1000 ml |
| pH (25° C.) | 4.0 |

A test was conducted on the color print papers O and P, after processing for the light storability and the dark heat storability described above. As a result, substantially the same results as those of A and B, respectively, were obtained.

EXAMPLE 2

A color photosensitive material 100 containing the following first layer to twelfeth layer coated in sequence to a paper support laminated on both sides with polyethylene was prepared. The polyethylene on the side of coating the first layer contained titanium white as a white pigment and a slight amount of ultramarine as a blue dye.

Composition for Photographic Layer

The ingredient and the coating amount represented by g/m$^2$ units are shown below. The coating amount of silver halide is calculated as silver.

| | |
|---|---|
| First layer (gelatin layer) | |
| Gelatin | 1.30 |
| Second layer (anti-halation layer) | |
| Black colloidal silver | 0.10 |
| Gelatin | 0.70 |
| Third layer (low sensitivity red sensitive layer) | |
| Silver iodobromochloride EMI (spectrally sensitized with red sensitizing dye (ExS-1, 2, 3) (silver chloride 1 mol %, silver iodide 4 mol %, average grain size, 0.3 μm, size distribution 10%, cubic, core iodine type core shell) | 0.06 |
| Silver iodobromide EM2 (spectrally sensitized with red sensitizing dye (ExS-1, 2, 3) (silver iodide 5 mol %, average grain size 0.45 μm, size distribution 20%, cubic (aspect ratio = 5)) | 0.10 |
| Gelatin | 1.00 |
| Cyan coupler (ExC-1) | 0.14 |
| Cyan coupler (ExC-2) | 0.07 |
| Discoloration inhibitor (Cpd-2, 3, 4, 9 in equimolar) | 0.12 |
| Coupler dispersant (Cpd-5) | 0.03 |
| Coupler dispersant (Solv-1, 2, 3) | 0.06 |
| Fourth layer (high sensitivity red sensitive layer) | |
| Silver iodobromide EM3 (spectrally sensitized with red sensitizing dye (ExS-1, 2, 3) (silver iodide 6 mol %, average grain size 0.75 μm, size distribution 25%, tabular (aspect ratio = 8, core iodine)) | 0.15 |
| Gelatin | 1.00 |
| Cyan coupler (ExC-1) | 0.20 |
| Cyan coupler (ExC-2) | 0.10 |
| Discoloration inhibitor (Cpd-2, 3, 4, 9 in equimolar) | 0.15 |
| Coupler dispersant (Cpd-5) | 0.03 |
| Coupler dispersant (Solv-1, 2, 3 in equivolume) | 0.10 |
| Fifth layer (intermediate layer) | |
| Magenta colloidal silver | 0.02 |
| Gelatin | 1.00 |
| Color mixing inhibitor (Cpd-6, 7) | 0.08 |
| Color mixing inhibitor solvent (Solv-4, 5) | 0.16 |
| Polymer latex (Cpd-8) (plasticizer) | 0.10 (solid content) |
| Sixth layer (low sensitivity green sensitive layer) | |
| Silver iodobromochloride EM4 (spectrally sensitized with green sensitizing dye (ExS-3) (silver chloride 1 mol %, silver iodide 2.5 mol %, average grain size 0.28 μm, size distribution 12%, cubic, core iodine type core/shell) | 0.04 |
| Silver iodobromide EM5 (spectrally sensitized with green sensitizing dye (ExS-3) (silver iodide 2.8 mol %, average grain size 0.45 μm, size distribution 12%, tabular (aspect ratio = 5)) | 0.06 |
| Gelatin | 0.80 |
| Magenta coupler (ExM-1) | 0.10 |
| Discoloration inhibitor (Cpd-9) | 0.10 |
| Stain inhibitor (Cpd-10) | 0.01 |
| Stain inhibitor (Cpd-11) | 0.001 |
| Stain inhibitor (Cpd-12) | 0.01 |
| Coupler dispersant (Cpd-5) | 0.05 |
| Coupler dispersant (Solv-4, 6) | 0.15 |
| Seventh layer (high sensitivity green sensitive layer) | |
| Silver iodobromide EM6 (spectrally sensitized with green sensitizing dye (ExS-3) (silver iodide 3.5 mol %, average grain size 0.9 μm, size distribution 23%, tabular (aspect ratio = 9, homogenous iodine type)) | 0.10 |
| Gelatin | 0.80 |
| Magenta coupler (ExM-1) | 0.10 |
| Discoloration inhibitor (Cpd-9) | 0.10 |
| Stain inhibitor (Cpd-10) | 0.01 |
| Stain inhibitor (Cpd-11) | 0.001 |
| Stain inhibitor (Cpd-12) | 0.01 |
| Coupler dispersant (Cpd-5) | 0.05 |
| Coupler dispersant (Solv-4, 6) | 0.15 |
| Eighth layer (yellow filter layer) | |
| Yellow colloidal silver | 0.20 |
| Gelatin | 1.00 |
| Color mixing inhibitor (Cpd-7) | 0.06 |
| Color mixing inhibitor solvent (Solv-4, 5) | 0.15 |
| Polymer latex (Cpd-8) | 0.10 |
| Ninth layer (low sensitivity blue sensitive layer) | |
| Silver bromoiodidochloride EM7 (spectrally sensitized with blue sensitizing dye (ExS-4, 5) (silver chloride 2 mol %, silver iodide 2.5 mol %, average grain size 0.35 μm, size distribution 8%, cubic, core iodine type core shell) | 0.07 |
| Silver bromoiodide EM8 (spectrally sensitized with blue sensitizing dye (ExS-4, 5) (silver iodide 2.5 mol %, average grain size 0.45 μm, size distribution 16%, tabular (aspect ratio = 6)) | 0.10 |
| Gelatin | 0.50 |
| Yellow coupler (ExY-1) | 0.20 |
| Stain inhibitor (Cpd-11) | 0.001 |
| Coupler solvent (Solv.-2) | 0.05 |
| Tenth layer (high sensitive blue sensitive layer) | |
| Silver iodobromide EM9 (spectrally sensitized with blue sensitizing dye (ExS-4, 5) (silver iodide 2.5 mol %, average grain size 1.2 μm, size distribution 21%, tabular (aspect ratio = 14)) | 0.25 |
| Gelatin | 1.00 |
| Yellow coupler (ExY-1) | 0.40 |
| Stain inhibitor (Cpd-11) | 0.002 |
| Coupler solvent (Solv-2) | 0.10 |
| Eleventh layer (UV absorption layer) | |
| Gelatin | 1.50 |
| UV absorber (Cpd-1, 3, 13) | 1.00 |
| Color mixing inhibitor (Cpd-6, 14) | 0.06 |
| Dispersant (Cpd-5) | 0.05 |
| UV absorber solvent (Solv-1, 2) | 0.15 |
| Irradiation inhibition dye (Cpd-15, 16) | 0.02 |

-continued

| | |
|---|---|
| Irradiation inhibition dye (Cpd-17, 18) | 0.02 |
| Twelfth layer (Protective layer) | |
| Fine grain silver bromochloride (silver chloride 97 mol %, average size 0.2 μm) | 0.07 |
| Acryl modified polyvinyl alcohol (modification degree 17%) | 0.02 |
| Gelatin | 1.50 |
| Gelatin hardener (H-1) | 0.17 |

Further, Alkanol XC (Dupont Co.) and sodium alkyl benzene sulfonate were used as emulsification dispersion aids and succinic acid ester and Megafac F-120 (manufactured by Dainippon Ink) were used as coating aids for each of the layers. Cpd-19, 20, 21 were used as stabilizer for the silver halide or colloidal containing layers. In this way, photosensitive material 100 was prepared.

The compounds used in the examples are shown below.

ExS-1

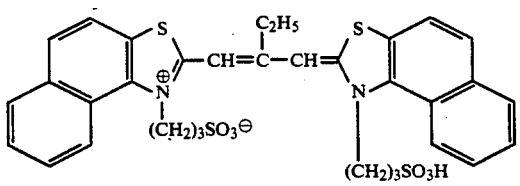

ExS-2

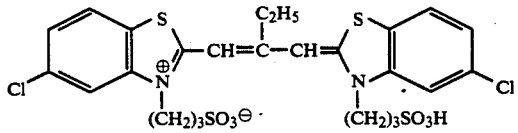

ExS-3

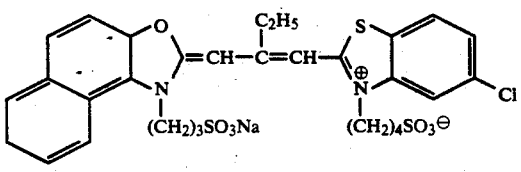

ExS-4

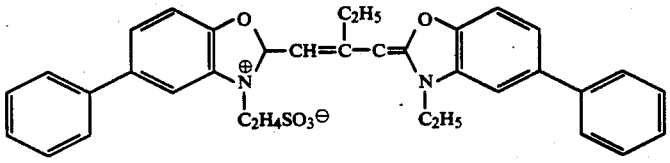

ExS-5

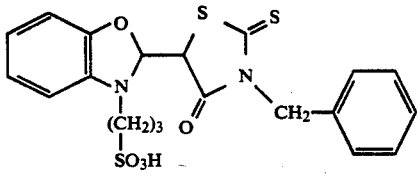

Cpd-1

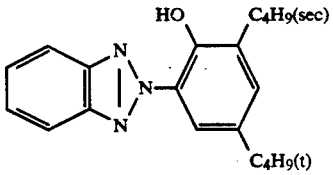

Cpd-2

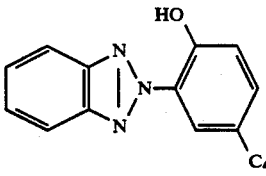

-continued
Cpd-3
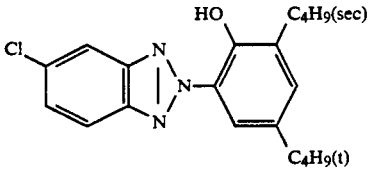
Cpd-4
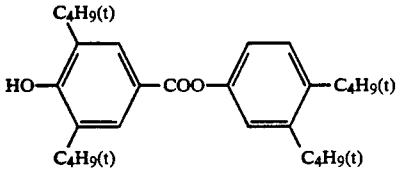
Cpd-5
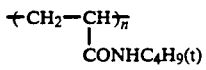
n = 400 (average value)
Cpd-6
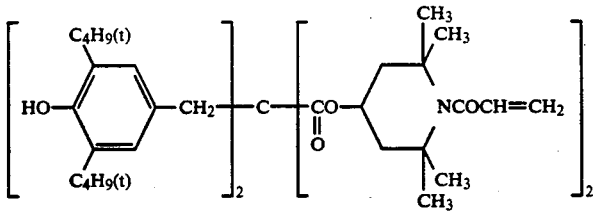
Cpd-7
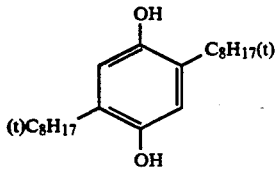
Polyethlacrylate
Cpd-8
Cpd-9
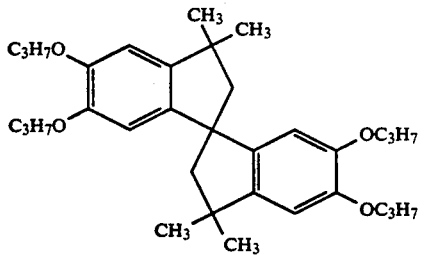
Cpd-10
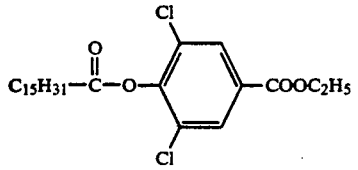
Cpd-11
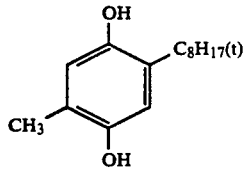

-continued
Cpd-12
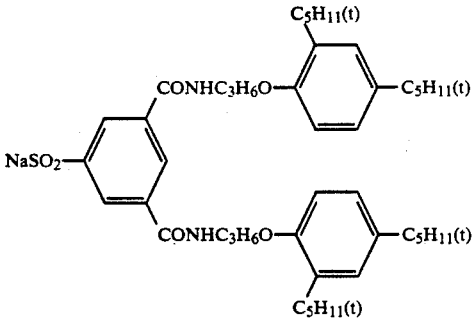
Cpd-13
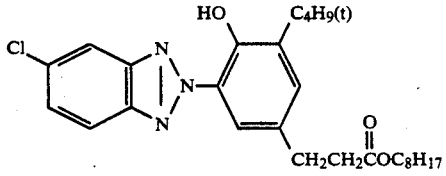
Cpd-14
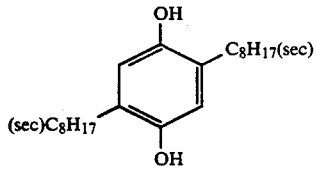
Cpd-15
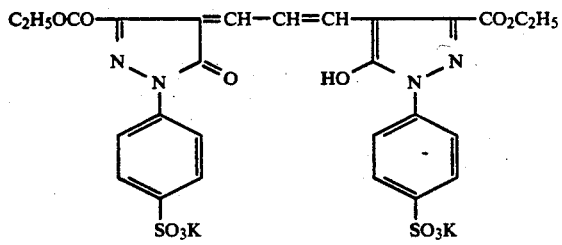
Cpd-16
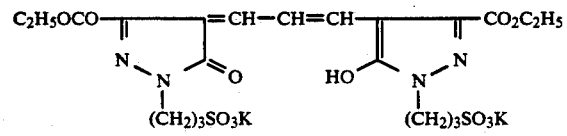
Cpd-17
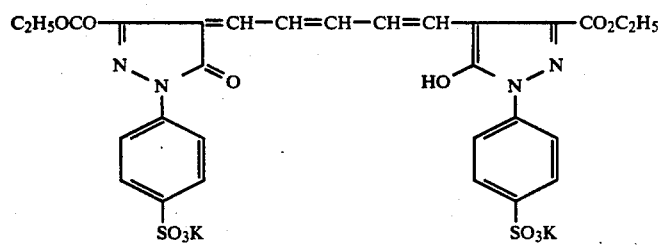
Cpd-18
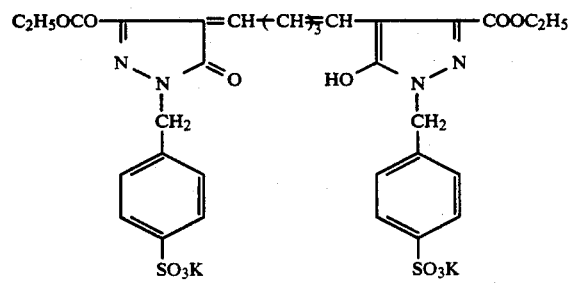

-continued

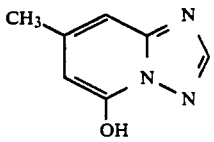

Cpd-19

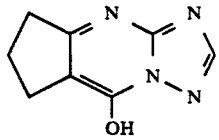

Cpd-20

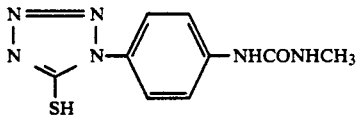

Cpd-21

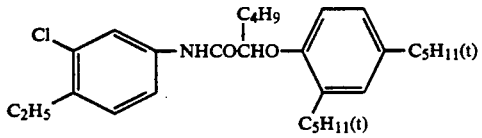

ExC-1

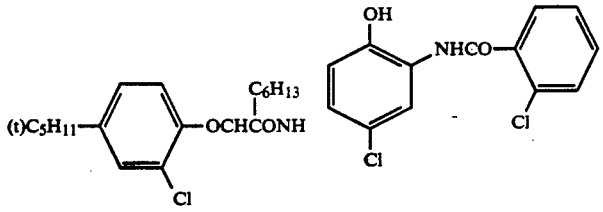

ExC-2

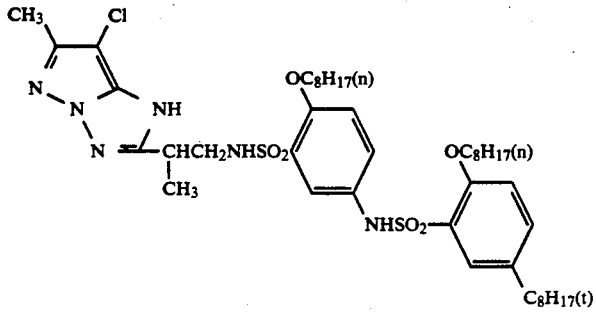

ExM-1

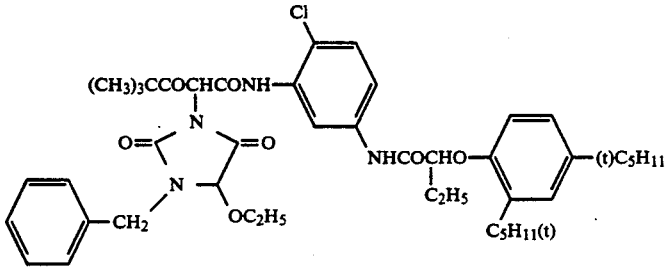

ExY-1

| | |
|---|---|
| Di(2-ethylhexyl)phthalate | Solv-1 |
| Trinonyl phosphate | Solv-2 |
| Di(3-methylhexyl)phthalate | Solv-3 |
| Tricresyl phosphate | Solv-4 |
| Dibutyl phthalate | Solv-5 |
| Trioctyl phosphate | Solv-6 |
| 1,2-bis(vinylsulfonylacetamido) ethane | Solv-7 |

Photosensitive materials 101-106 were prepared in the same manner as photosensitive material 100, by changing the yellow coupler and the coupler solvent present in the ninth layer and the tenth layer of photosensitive material 100, and further adding the epoxy compounds of the present invention. The composition is shown in Table 3.

TABLE 3

| Photo-sensitive material | Yellow coupler layer (ninth layer, tenth layer): Yellow coupler | Epoxy compound (addition amount ratio to coupler) | Coupler solvent (addition amount ratio to coupler) | Remarks |
|---|---|---|---|---|
| 100 | ExY-1 | — | Solv-2 0.25 (g/g) | Comparison |
| 101 | " | Exemplified compound (II-5) 0.25 (g/g) | — | This invention |
| 102 | " | Exemplified compound (II-5) 0.15 | Solv-2 0.10 | This invention |
| 103 | " | Exemplified compound (II-1) 0.15 | Solv-5 | This invention |
| 104 | Exemplified coupler (I-6) | — | Solv-4 0.25 | Comparison |
| 105 | Exemplified coupler (I-6) | Exemplified compound (II-3) 0.25 | — | This invention |
| 106 | Exemplified coupler (I-6) | Exemplified compound (II-3) 0.15 | Solv-4 0.10 | This invention |

After continuous gradation exposure of these specimens through a sensitometry optical wedge, the processing shown below was applied.

| (Processing step) | | |
|---|---|---|
| First development (black-and-white development) | 38° C. | 1'15" |
| Water washing | 38° C. | 1'30" |
| Reverse exposure | at least 100 Lux | at least 1" |
| Color development | 38° C. | 2'15" |
| Water washing | 38° C. | 45" |
| Bleach-fixing | 38° C. | 2'00" |
| Water washing | 38° C. | 2'15" |

(Composition for processing solution)

First Developer

| | |
|---|---|
| Pentasodium nitrilo-N,N,N-trimethylene phosphonate | 0.6 g |
| Pentasodium diethylenetriamine pentaacetate | 4.0 g |
| Potassium sulfite | 30.0 g |
| Potassium thiocyanate | 1.2 g |
| Potassium carbonate | 35.0 g |
| Potassium hydroquinone monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Made up with water to | 1 liter (pH 9.70) |

Liquid color developer

| | |
|---|---|
| Benzyl alcohol | 15.0 ml |
| Diethylene glycol | 12.0 ml |
| 3,6-dithia-1,8-octanediol | 0.2 g |
| Pentasodium nitrilo-N,N,N-trimethylene phosphate | 0.5 g |
| Pentasodium diethylenetriamine pentaacetate | 2.0 g |
| Sodium sulfite | 2.0 g |
| Potassium carbonate | 25.0 g |
| Hydroxylamine sulfate | 3.0 g |
| N-ethyl-N-(β-methanesulfonamidoethyl)-3-methyl-4-aminoaniline sulfate | 5.0 g |
| Potassium bromide | 0.5 g |
| Potassium iodide | 1.0 mg |
| Made up with water to | 1 liter (pH 10.40) |

Bleach-fixing solution

| | |
|---|---|
| 2-Mercapto-1,3,4-triazole | 1.0 g |
| Disodium ethylenediamine tetraacetate 2 hydrate | 5.0 g |
| Fe(III) ammonium ethylenediamine tetraacetate monohydrate | 80.0 g |
| Sodium sulfite | 15.0 g |
| Sodium thiosulfate (700 g/l solution) | 160.0 ml |
| Glacial acetic acid | 5.0 ml |
| Made up with water to | 1 liter (pH 6.50) |

The following experiments were conducted on each of the samples after development for light fastness, heat fastness and wet heat fastness. The degree of discoloration was examined for each of the cases where the sample was left at 100° C. in a dark place for 6 days, a sample was left at 80° C., 70% RH in a dark place for 12 days and a sample was irradiated with light using a xenon tester (85,000 lux) for 6 days, and the result represented by the reduction of density relative to the initial density of 1.5, as shown in Table 4.

TABLE 4

| Specimen | Dark discoloration: 100° C., 6 days (%) | Dark discoloration: 80° C., 70% RH 12 days (%) | Light discoloration Xenon, 6 days (%) | Remark |
|---|---|---|---|---|
| 100 | 38 | 35 | 19 | Comparison |
| 101 | 11 | 10 | 13 | This Invention |
| 102 | 13 | 11 | 12 | This Invention |
| 103 | 10 | 11 | 11 | This Invention |
| 104 | 42 | 38 | 23 | Comparison |
| 105 | 12 | 11 | 14 | This Invention |
| 106 | 11 | 11 | 13 | |

As is apparent from the result in Table 4, the dark discoloration and optical discoloration of the yellow image was remarkably improved by the epoxy compound according to the present invention.

According to the silver halide color photosensitive material of the present invention, excellent dye images with improved yellow image storability, and with no undesired effects on various photographic properties, can be obtained by combining the yellow coupler of the present invention with the epoxy compound of the present invention.

Among all, light fastness, heat resistance and humidity resistance can be improved in a well-balanced state. In addition, by using the magenta coupler according to the present invention, color images well balanced for storability of the yellow and magenta color images can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprised of a support having thereon at least one light-sensitive emulsion layer containing at least one yellow coupler represented by the general formula (I) and a sparingly water soluble epoxy compound represented by the general formula (II) and having a solubility in water at 18° C. of not more than 1% by weight, said epoxy compound being present in an amount of 20 to 200 weight % based on the amount of coupler represented by formula (I):

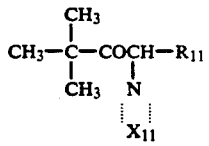

(I)

where $R_{11}$ represents a substituted N-phenylcarbamoyl group having 7 to 42 carbon atoms wherein the substituent is selected from a member consisting of an aliphatic group, an aliphatic oxy group, an aromatic oxy group, an ester group, an amido group, a carbamoyl group, a sulfamoyl group, an imido group and a halogen atom and $X_{11}$ represents a non-metallic atomic group required for forming a 5- or 6-membered ring; and the coupler may form a dimer or a higher polymer;

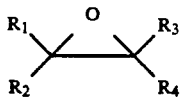

(II)

$R_1$, $R_2$, $R_3$ and $R_4$, which may be the same or different, each represents a hydrogen atom, an aliphatic group, an aryl group, an aliphatic oxycarbonyl group, an aromatic oxycarbonyl group or a carbamoyl group, provided at least one of $R_1$, $R_2$, $R_3$ and $R_4$ represents a group other than hydrogen atoms; the total number of the carbon atoms contained in $R_1$, $R_2$, $R_3$ and $R_4$ is from 8 to 60; $R_1$ and $R_2$, $R_3$ and $R_4$, or $R_1$ and $R_3$ may be linked to form a 5 - to 7-membered ring; at least one of $R_1$, $R_2$, $R_3$ and $R_4$ may have at least one epoxy group; and the epoxy compound may form a dimer or a higher polymer.

2. The silver halide color photographic liight-sensitive material as claimed in claim 1, wherein said photographic light-sensitive material contains at least one compound selected from the group consisting of compounds represented by the general formula (M-I) and general formula (M-II) as a magenta coupler

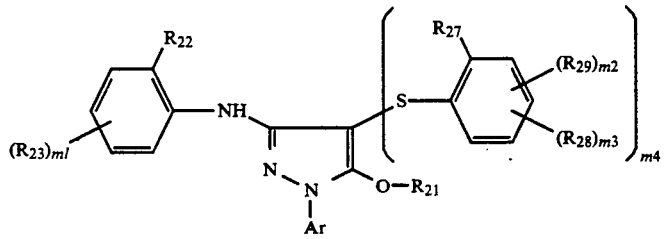

(M-I)

wherein Ar represents an aryl group; $R_{21}$ represents a hydrogen atom, an acyl group, or a sulfonyl group, $R_{22}$ represents a halogen atom or an alkoxy group; $R_{23}$ represents an alkyl group, an aryl group, a halogen atom, an alkoxy group, an aryloxy group, an acylamino group, an imido group, a sulfonamido group, an alkoxycarbonyl group, a carbamoyl group, a sulfamoyl group, an alkylthio group or a sulfonyl group; $R_{27}$ represents an alkyl group, an alkoxy group, an aryloxy group or an acylamino group; $R_{29}$ represents a hydrogen atom, a halogen atom, a hydroxyl group, an alkyl group, an alkoxy group or an aryl group; $R_{28}$ represents an amino group, an acylamino group, a ureido group, an alkoxycarbonylamido group, an imido group, a sulfonamido group, a sulfamoylamino group, an alkoxycarbonyl group, a carbamoyl group, an acyl group, cyano group or an alkylthio group; provided that at least one of $R_{27}$ and $R_{29}$ represents an alkoxy group, ml is an integer of 1 to 4, $m^2$ is an integer of 1 to 4, m3 is 0 or an integer of 1 to 3, m4 is 1, and the coupler may form a dimer or a higher polymer;

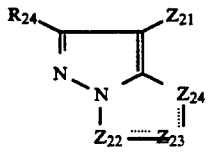

(M-II)

$R_{24}$ represents a hydrogen atom or a substituent; $Z_{21}$ represents a hydrogen atom or a coupling-off group capable of being released by a reaction with an oxidized product of an aromatic primary amine color developing agent; $Z_{22}$, $Z_{23}$ and $Z_{24}$, which may be the same or different, each represents

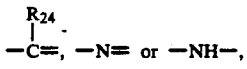

provided that one of the $Z_{24}$–$Z_{23}$ bond and the $Z_{23}$–$Z_{22}$ bond is a double bond and the other is a single bond, when the $Z_{23}$–$Z_{22}$ bond is a carbon-carbon double bond, it constitutes a part of an aromatic ring; and the coupler may form a dimer or a higher polymer.

3. The silver halide color photographic light-sensitive material as claimed in claim 2, wherein said material contains at least one magenta coupler represented by formula (M-II).

4. The silver halide color photographic light-sensitive material as claimed in claim 1, wherein said photographic light-sensitive material contains at least one compound represented by the general formula (C-1) as a cyan coupler:

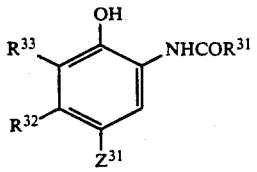

(C-I)

wherein R⁻represents an alkyl group, an aryl group, an amino group or a heterocyclic group; $R^{32}$ represents an acylamino group or an alkyl group; $R^{33}$ represents a hydrogen atom, a halogen atom, an alkyl group or an alkoxy group; $R^{33}$ and $R^{32}$ may be linked to form a ring; $Z^{31}$ represents a hydrogen atom or a coupling-off group; a dimer or a higher polymer may be formed at $R^{31}$, $R^{32}$, or $Z^{31}$.

5. The silver halide color photographic light-sensitive material as claimed in claim 1, wherein said yellow coupler is represented by the general formula (I-A):

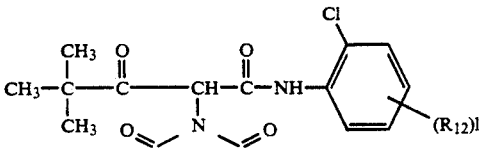

(I-A)

$X_{12}$ wherein $X_{12}$ represents a non-metallic atomic group necessary for forming a 5-membered ring; $R_{12}$ represents an aliphatic group, an aliphatic oxy group, an aromatic oxy group, an ester group, an amido group, a carbamoyl group, a sulfamoyl group, an imido group, or a halogen atom; and l represents an integer of from 1 to 4.

6. The silver halide color photographic light-sensitive material as claimed in claim 1, wherein the amount of the yellow coupler represented by the general formula (I) is from $1\times10^{-2}$ to 1 mol per mol silver halide in the silver halide emulsion layer.

7. The silver halide color photographic light-sensitive material as claimed in claim 1, wherein said photographic light-sensitive material comprises at least one blue sensitive emulsion layer, at least one green, sensitive emulsion layer, and at least one red sensitive emulsion layer.

8. The silver halide color photographic light-sensitive material as claimed in claim 7, wherein said blue sensitive emulsion layer contains a yellow coupler, said green sensitive emulsion layer contains a magenta coupler, and said red sensitive emulsion layer contains a cyan coupler.

9. The silver halide color photographic light-sensitive material as claimed in claim 1, wherein the yellow coupler represented by the general formula (I) is incorporated in at least one blue sensitive emulsion layer.

* * * * *

UNITED STATES PATENT AND TRADEMARK OFFICE

CERTIFICATE OF CORRECTION

PATENT NO. : 5,183,731 B1
DATED : February 6, 2001
INVENTOR(S) : John Casey; Jayne Elizabeth Ellis; Corrine Jane Austin It is certified that error appears in the above-identified patent and that said Letters Patent is hereby corrected as shown below:

Title page,
Line 2, delete "Carey et al." and insert therefor -- Casey et al. --.
Line 5, delete "John Carey" and insert therefor, -- John Casey --.

Signed and Sealed this

Sixth Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,183,731
DATED : February 2, 1993
INVENTOR(S) : Osamu Takahashi et al.

It is certified that error appears in the above-identified patent and that said Letters Patent is hereby corrected as shown below:

This certificate supersedes Certificate of Correction issued November 6, 2001, the number was erroneously mentioned and should be vacated since no Certificate of Correction was granted.

Signed and Sealed this

Twenty-second Day of April, 2003

JAMES E. ROGAN
*Director of the United States Patent and Trademark Office*